US012522989B2

(12) United States Patent
Kim et al.

(10) Patent No.: US 12,522,989 B2
(45) Date of Patent: Jan. 13, 2026

(54) ASSEMBLY TYPE BRIDGE LOWER STRUCTURE HAVING SOCKET TYPE ELASTIC DUCT COUPLER AND METHOD OF CONSTRUCTING THE SAME

(71) Applicant: KOREA RAILROAD RESEARCH INSTITUTE, Gyeonggi-do (KR)

(72) Inventors: Taehoon Kim, Gyeonggi-do (KR); Ki Young Eum, Gyeonggi-do (KR); InHo Yeo, Seoul (KR); Yun Suk Kang, Gyeonggi-do (KR); Dae-Sang Kim, Gyeonggi-do (KR); Choon Seok Bang, Gyeonggi-do (KR); Sungil Kim, Gyeonggi-do (KR); Jeong Ryol Shin, Gyeonggi-do (KR); Ki Hyun Kim, Seoul (KR)

(73) Assignee: KOREA RAILROAD RESEARCH INSTITUTE, Gyeonggi-do (KR)

( * ) Notice: Subject to any disclaimer, the term of this patent is extended or adjusted under 35 U.S.C. 154(b) by 620 days.

(21) Appl. No.: 17/982,522

(22) Filed: Nov. 8, 2022

(65) Prior Publication Data

US 2023/0167614 A1 Jun. 1, 2023

(30) Foreign Application Priority Data

Nov. 30, 2021 (KR) ..... 10-2021-0168829

(51) Int. Cl.
*E01D 19/00* (2006.01)
*E01D 19/02* (2006.01)
(Continued)

(52) U.S. Cl.
CPC ..... *E01D 19/02* (2013.01); *E01D 21/00* (2013.01); *E01D 2101/285* (2013.01)

(58) Field of Classification Search
CPC .... E01D 19/02; E01D 21/00; E01D 2101/285
(Continued)

(56) References Cited

U.S. PATENT DOCUMENTS 4,910,940 A * 3/1990 Grady, II ..... E04B 5/08 52/223.5
5,826,387 A * 10/1998 Henderson ..... E02D 27/42 405/251

(Continued)

FOREIGN PATENT DOCUMENTS

CN 107806010 A * 3/2018 ..... E01D 19/02
CN 107988895 A * 5/2018 ..... E01D 19/02

(Continued)

*Primary Examiner* — Raymond W Addie
(74) *Attorney, Agent, or Firm* — JCIPRNET

(57) ABSTRACT

The present disclosure provides an assembly type bridge lower structure having a socket type elastic duct coupler and a method of constructing the same in which, in construction of an assembly type bridge lower structure that consists of an assembly type foundation part, an assembly type pillar part, and an assembly type coping part, a socket type elastic duct coupler is utilized, thus enabling shear key joining at connection portions of the assembly type foundation part, the assembly type pillar part, and the assembly type coping part, easily accommodating of construction error displacements of the socket type elastic duct coupler, improving watertightness at connection portions of the precast segments, easily accommodating an insertion angle of the insertion member including a steel strand, a steel bar, a reinforcing bar, a FRP, or the like, and preventing an overflow phenomenon that occurs when epoxy is excessively applied during bonding between the precast segments.

14 Claims, 14 Drawing Sheets

(51) Int. Cl.
*E01D 21/00* (2006.01)
*E01D 101/28* (2006.01)

(58) Field of Classification Search
USPC ..... 14/75, 77.1, 77.3
See application file for complete search history.

(56) References Cited

U.S. PATENT DOCUMENTS

| | | | | |
|---|---|---|---|---|
| 7,832,178 | B2 * | 11/2010 | Rouse | E04C 3/34 52/843 |
| 8,341,788 | B2 * | 1/2013 | Kim | E01D 19/00 14/77.3 |
| 8,464,482 | B2 | 6/2013 | Raynor | |
| 8,667,750 | B2 | 3/2014 | Speer | |
| 2002/0124502 | A1 * | 9/2002 | Henderson | E02D 27/425 52/741.15 |

FOREIGN PATENT DOCUMENTS

| | | | | |
|---|---|---|---|---|
| CN | 111501525 | A * | 8/2020 | E01D 19/02 |
| KR | 100704874 | B1 * | 4/2007 | E01D 19/02 |
| KR | 100738999 | | 7/2007 | |
| KR | 100920204 | | 10/2009 | |
| KR | 100924746 | | 11/2009 | |
| KR | 100950715 | | 3/2010 | |
| KR | 100971001 | | 7/2010 | |
| KR | 100971003 | | 7/2010 | |
| KR | 101039656 | | 6/2011 | |

* cited by examiner a)

b)

ASSEMBLY TYPE BRIDGE LOWER STRUCTURE HAVING SOCKET TYPE ELASTIC DUCT COUPLER AND METHOD OF CONSTRUCTING THE SAME

CROSS-REFERENCE TO RELATED APPLICATION

This application claims priority to and the benefit of Korean Patent Application No. 10-2021-0168829, filed on Nov. 30, 2021, the disclosure of which is incorporated herein by reference in its entirety.

BACKGROUND

1. Field of the Invention

The present disclosure relates to an assembly type bridge lower structure, and more particularly, to an assembly type bridge lower structure having a socket type elastic duct coupler and a method of constructing the same in which, in construction of an assembly type bridge lower structure that consists of an assembly type foundation part, an assembly type pillar part, and an assembly type coping part, a socket type elastic duct coupler embedded in each precast segment is used to connect and construct each of the assembly type foundation part, the assembly type pillar part, and the assembly type coping part.

2. Discussion of Related Art

In most bridge constructions, after a foundation is completed, a formwork is installed, and concrete is placed therein to construct a lower structure, the same process is repeatedly and sequentially performed to manufacture an upper structure. Such a construction process is a site-oriented process that is labor-intensive, and a large amount of time is taken for installation and removal of a formwork, curing of concrete, and the like.

Also, bridge construction by placing concrete on site increases a construction period and causes environmental problems, which may cause civil complaints. Thus, in recent years, the use of such a construction method has been reduced, and instead, the use of a fast construction method in which precast segments are constructed by assembly on site has been increased.

The fast construction method can not only shorten the overall bridge construction period but also minimize environmental problems and civil complaints, and due to requiring the use of large machinery, the fast construction method is contributing to mechanization of a construction environment.

In a case in which precast segments are assembled in the fast construction method, for shear connection of discontinuous surfaces that are present between the precast segments, shear keys should be installed so that shear resistance is displayed due to mechanical engagement.

For example, in the case of a precast concrete segment, a shear key is formed in the shape of a protrusion on one side of the precast segment when manufacturing the precast segment.

However, in a case in which the shear key in the shape of a protrusion is manufactured on one side of the precast segment, when removing the formwork, the shear key may be easily damaged due to minor carelessness.

In particular, the smaller the size of the shear key and the larger the protruding length thereof, the easier it is for the shear key to be damaged during the precast segment manufacturing process.

Also, when a shear key forming portion of a formwork is not properly filled with concrete and the formwork is removed, a case in which the shear key is not formed in a desired shape on the precast segment often occurs.

Also, in a case in which tendons are continuously arranged in neighboring precast segments, leakage of water may occur through a discontinuous surface between the precast segments.

Leakage of water through a tendon installation hole that occurs through a discontinuous surface between the precast segments, that is, a bonding surface between the precast segments, causes corrosion of tendons, which leads to damage to the tendons and thus may cause a serious problem to the overall structure, such as a collapse of the structure.

Meanwhile, in the case of a bridge lower structure that consists of a foundation part, a pillar part, and a coping part, a method of construction by assembly using precast segments has been proposed. First, as the related art of a method of constructing a pillar part by assembly using precast segments, Korean Patent Registration No. 10-738999 discloses "Precast concrete segment having assembly structure using steel duct and connection and assembly structure thereof" and relates to a vertical joining structure of a segment, in which a steel duct is embedded, in a pillar part of a bridge lower structure, which will be described with reference to FIG. 1.

FIG. 1 is a view illustrating the assembly of precast concrete segments having an assembly structure using a steel duct according to the related art, wherein a) of FIG. 1 is a schematic perspective view showing a process in which precast concrete segments are vertically assembled to each other, and b) of FIG. 1 is a view illustrating a state in which segments of precast concrete piers are stacked.

As illustrated in a) and b) of FIG. 1, in the precast concrete segment having an assembly structure using a steel duct according to the related art, since a steel duct which is used to arrange tendons and also serves as a shear key is provided in a state of being integrally embedded inside, the overall structure may be formed by easily assembling the precast concrete segment while having a sufficient stiffening force for a shear force.

In the case of the precast concrete segment having an assembly structure using a steel duct according to the related art, a steel duct 1 which is formed of a cylindrical steel pipe and has a tendon, into which a tensile force will be introduced, disposed to pass therethrough is provided in a state of being embedded inside while passing through a precast concrete segment 10 in a direction of assembly to a neighboring precast concrete segment 10.

Also, an upper end portion of the steel duct 1 is disposed to protrude past an upper surface of the precast concrete segment 10 in order to serve as a shear key. Also, a lower end portion of the steel duct 1 is formed of a pipe expansion part 11 whose diameter is expanded to allow a protruding upper end portion of a steel duct 1 of a neighboring precast concrete segment 10 to be inserted thereinto.

According to the precast concrete segment having an assembly structure using a steel duct according to the related art, since the steel duct is disposed across both sides in a bonding part of both side segments and serves as a shear key, sufficient shear resistance may be displayed at the bonding part of the precast concrete segments.

In particular, since it becomes possible to integrally form a normal, undamaged shear key with a segment when steel ducts are installed corresponding to set positions and concrete is placed to manufacture precast concrete segments, a shear key formation task may be performed very easily. Also, since the steel ducts are continuously installed in a discontinuous surface between the precast segments, it is possible to prevent leakage of water to the inside of the ducts due to the bonding surface between the precast segments, and by using the steel ducts, concrete strength of the segment itself is further increased, and thus a cleaner segment may be manufactured.

In other words, in the case of the precast concrete segment having an assembly structure using a steel duct according to the related art, in a pillar part, a steel duct is embedded in each precast segment, the steel ducts are joined to each other to assemble the precast segments, and thus tendons are disposed inside the steel ducts, and the joining structure of the steel ducts serves as a shear key.

However, when the steel ducts are utilized by being embedded as above, in a case in which an error occurs in the positions where the steel ducts are embedded, a problem may occur in a joining portion due to a construction error caused by joining the steel ducts, and accordingly, inserting a steel strand, a steel bar, a reinforcing bar, and the like to connect the precast segments may be greatly interfered with.

Meanwhile, as the related art of a horizontal connection structure of a coping part and a shear key in a bridge lower structure, Korean Patent Registration No. 10-924746 discloses "Method of constructing precast coping part to which multi-stage tension is applied," which will be described with reference to FIG. 2.

FIG. 2 is a cross-sectional view illustrating a configuration of a precast coping part according to the method of constructing a precast coping part to which multi-stage tension is applied according to the related art.

Referring to FIG. 2, in the method of constructing a precast coping part 30 to which multi-stage tension is applied according to the related art, first, a main segment 31 is formed in a rectangular parallelepiped shape larger than a diameter of a structural segment 41, a socket that corresponds to a shear connector of the structural segment 41, a longitudinal sheath pipe 31*a*, and a reinforcing bar 31*b* are provided, and one or more rows of first transverse sheath pipes 31*c* are formed at set positions so that a transverse tendon 34 passes therethrough. Here, the main segment 31 has a plurality of shear keys in the form of protrusions formed on both side surfaces to firmly connect auxiliary segments 32 to each other during assembly thereof and to efficiently support a load applied to an upper portion.

Also, the auxiliary segment 32 is formed in a rectangular parallelepiped shape whose length and height are less as compared to the main segment 31, is formed to have an inclined bottom surface so that a self-load is decreased and a load is concentrated on the main segment 31, and has a second transverse sheath pipe 32*b* formed to correspond to the first transverse sheath pipe 31*c* of the main segment 31 so that the transverse tendon 34 passes therethrough. Here, the auxiliary segment 32 is manufactured through match casting using both side surfaces of the main segment 31 as a formwork and has a shear key groove 32*c* coupled to the shear key of the main segment 31 formed in one side surface.

An additional segment 33 may be further installed due to an outer side of each auxiliary segment 32. In this case, a plurality of auxiliary shear keys 32*d* in the form of protrusions are provided on the other side surface of the auxiliary segment 32.

Also, the additional segment 33 is formed in a rectangular parallelepiped shape whose length and height are less as compared to the auxiliary segment 32, is formed to have an inclined bottom surface so that a self-load is decreased and a load is concentrated on the main segment 31, and has a third transverse sheath pipe 33*a* formed to correspond to the second transverse sheath pipe 32*b* of the auxiliary segment 32 so that the transverse tendon 34 passes therethrough. Here, the additional segment 33 is manufactured through match casting using one side surface of the auxiliary segment 32 as a formwork and has an auxiliary shear key groove coupled to the auxiliary shear key 32*d* of the auxiliary segment 32 formed in one side surface.

According to the method of constructing a precast coping part to which multi-stage tension is applied according to the related art, a coping part is constructed using a plurality of segments, a transverse tensile force is introduced through a tendon between neighboring segments to allow application to small and medium-sized bridges, fast construction is possible such that a construction period and construction costs can be relatively decreased, and retensioning of the tendon is possible such that maintenance and repair are facilitated.

Also, according to the method of constructing a precast coping part to which multi-stage tension is applied according to the related art, during manufacture of neighboring precast segments, by manufacturing using match casting in which side surfaces of precast segments are used as a formwork to manufacture new precast segments, coupling between the precast segments is facilitated during construction, and by removing discontinuous surfaces between the neighboring precast segments, leakage of water through the discontinuous surfaces between the precast segments is prevented when continuously arranging tendons in the neighboring precast segments.

Also, according to the method of constructing a precast coping part to which multi-stage tension is applied according to the related art, during assembly of a segment and a neighboring segment, the segments are coupled to each other through a shear key so that the segments are firmly connected to each other, and a load applied to an upper portion is efficiently supported. Also, since units of segments are manufactured in factories, the units of segments may be easy to transport.

In other words, in a coping part of an assembly type bridge lower structure, a convex portion is formed on a central segment, a concave portion is formed in an adjacent segment to connect and join the convex portion and the concave portion which serve as a shear key, the central and adjacent segments are bonded by epoxy applied thereon, and by a sheath pipe passing through both the central and adjacent segments and a tendon embedded therein, joining of the central and adjacent segments is promoted while a tensile force is imparted.

Meanwhile, as the related art of a horizontal embedding structure of a transverse sheath pipe of a foundation part and a vertical segment connection structure with a pillar part in a bridge lower structure, Korean Patent Registration No. 10-920204 discloses "Method of constructing precast foundation part for bridge," which will be described with reference to FIG. 3.

FIG. 3 is a view for describing a method of constructing a precast foundation part for a bridge according to the related art.

As illustrated in FIG. 3, in the method of constructing a precast foundation part for a bridge according to the related art, a precast member 50 is manufactured in a factory and transported to an installation site. Then, footing foundation is constructed on a pile, and a traditional panel using a laminate or an improved panel such as Euroform is used to assemble a formwork on the pile.

Next, the precast member 50 is installed on a central portion inside the assembled formwork using lifting equipment such as a crane, and when installation of the precast member 50 is completed, a stiffening sheath pipe 62 is installed to correspond to a transverse sheath pipe 52 of the precast member 50, and a foundation reinforcing bar 61 is arranged to intersect the stiffening sheath pipe 62.

Next, concrete is placed in the formwork and cured, and then, when curing is completed, a transverse tendon 63 is inserted into the transverse sheath pipe 52 and the stiffening sheath pipe 62 and then tensioned to introduce a transverse tensile force.

Next, when the tensile force is introduced, a pier structure prefabricated using a shear part 51 of the precast member 50 is sequentially assembled on an upper surface of the foundation part to complete a pier.

According to the method of constructing a precast foundation part for a bridge according to the related art, a longitudinal sheath pipe, a longitudinal tendon, a fixing part made of a fixer or a U-shaped sheath pipe, and a precast member prefabricated to have a shear part integrally formed with an upper surface are installed on the ground, and then the rest of the foundation part is placed on site at a side surface of the precast member so as to be linked to the precast member so that a construction period of the foundation part is relatively shortened, and constructability is improved. Also, by using the precast member for the foundation part, quality and performance can be further improved as compared to placing on site, and problems of the foundation part that occur while placing on site can be addressed.

Meanwhile, as another related art, Korean Patent Registration No. 10-971003 discloses "Match casting formwork and method of constructing assembly type precast pier using the same," which will be described with reference to FIG. 4.

FIG. 4 is a view for describing a match casting technique for construction of an assembly type precast pier according to the related art.

As illustrated in FIG. 4, in the case of the match casting technique for construction of an assembly type precast pier according to the related art, each segment is moved to a pier installation site, and then starting from a pier foundation segment 71, the segments are sequentially stacked to complete a pier. Here, through placing on site, the rest of the pier foundation part is constructed and fabricated on a side surface of the pier foundation segment 71. Also, a longitudinal tendon 74 is inserted to stack the pier foundation segment 71, pier structure segments 72*a*, 72*b*, and 72*c*, and a pier coping segment 73, and then the longitudinal tendon 74 is tensioned and then fixed.

According to the match casting technique for construction of an assembly type precast pier according to the related art, a pier foundation part, a pier structure part, and a coping part are each fabricated using precast segments. During fabrication of precast segments stacked on an upper surface, match casting in which new precast segments are fabricated with upper surfaces of existing precast segments as a formwork is used for fabrication, and by facilitating coupling between a shear connector and a socket between precast segments and removing discontinuous surfaces, leakage of water through the discontinuous surfaces between the precast segments is prevented when continuously arranging tendons in the precast segments.

Also, during fabrication of precast segments that correspond to the pier structure part, the precast segments are fabricated using formworks that can be alternately lifted and lowered by rotating and sliding. Thus, the formworks can be easily attached or detached, and a construction period can be shortened. Also, by allowing precast segments to be coupled to each other through a shear connector and a shear socket during stacking of the precast segments, the precast segments may be firmly connected, and a load applied to an upper portion may be efficiently supported.

In other words, in a foundation part of an assembly type bridge lower structure, a central precast member having a sheath pipe formed in a transverse direction is installed, a stiffening sheath pipe is installed to correspond to the transverse sheath pipe, and then concrete is placed and cured adjacent to the central precast member so that the stiffening sheath pipe is embedded in the adjacent concrete. A transverse tendon is inserted to pass through the transverse sheath pipe and the stiffening sheath pipe and then tensioned to introduce a transverse tensile force.

Specifically, a cylindrical shear part is formed to protrude from a central precast member of a foundation part, and prefabricated pier structures are sequentially assembled to complete a pier. Here, it can be seen that a transverse sheath pipe is installed in both a coping part and the foundation part and a transverse tendon is installed therein to impart a tensile force, a central portion and an adjacent portion are joined through the transverse sheath pipes, and a configuration for reinforcing a shear force of the central portion and the adjacent portion is not separately provided in the foundation part. Although a shear key configuration is separately disclosed for the coping part, in a case in which the shear key is damaged during fabrication of segments or a problem occurs in formation of the shear key, a problem may occur in a shear key connection configuration, and accordingly, there is a need for another configuration that can reinforce a shear force.

Meanwhile, as still another related art, Korean Patent Registration No. 10-1039656 discloses "PSC pier assembled using precast concrete segments including steel duct and steel pipe and method of constructing the same," which will be described with reference to FIGS. 5A and 5B.

FIG. 5A is a cross-sectional view illustrating a configuration of a pier foundation in a prestressed concrete (PSC) pier assembled using precast concrete segments including a steel duct and a steel pipe according to the related art, and FIG. 5B is a perspective view illustrating a configuration of a segment in the PSC pier assembled using the precast concrete segments including the steel duct and the steel pipe.

As illustrated in FIG. 5A, a pier foundation 81 in the PSC pier assembled using precast concrete segments including a steel duct and a steel pipe according to the related art is placed on site, and a plurality of shear connectors 93 for shear connection are inserted into an upper end portion of the pier foundation 81 so that the shear connectors 93 are formed to protrude from an upper surface.

Also, the pier foundation 81 includes a plurality of foundation sheath pipes 81*a* and a steel wire 91 formed to extend by as much as a pier length and inserted into the foundation sheath pipes 81*a*. A segment groove 81*b* is formed in an upper surface at inner and outer sides of the shear connectors 93, a surface of the groove 81*b* is chipped to facilitate attachment of non-shrink mortar, and a rubber pad 81*c* for maintaining horizontalness and preventing leakage of water through the filled non-shrink mortar is further inserted and installed in the groove 81*b*. Here, a fixer 92 for fixing the steel wire 91 is connected and installed at one end of the foundation sheath pipe 81*a*.

Also, in the pier foundation 81, when curing is completed, a steel wire supporting steel pipe 94, which has the same length as the steel wire 91, is inserted between the foundation sheath pipe 81*a* and the steel wire 91, and the steel wire supporting steel pipe 94 is fixed by a supporting reinforcing bar 81*d*.

Also, as illustrated in FIG. 5B, a precast segment 82 is formed in a rectangular parallelepiped or cylindrical shape, which is filled or hollow, and includes a plurality of shear connectors 93 formed on an upper surface and a plurality of connection sockets formed in a bottom surface corresponding thereto. Also, the segment 82 further includes segment sheath pipes, which correspond one-to-one to the foundation sheath pipes 81*a* to allow the steel wire and the steel wire supporting steel pipe to pass therethrough and which extend from a lower end of the shear connector to an upper end of the connection socket. Also, a chamfer part 82*a* is formed on a corner of the segment 82, a sealant is combined with the chamfer part 82*a*, a ring-shaped sealing groove 82*b* is formed a predetermined distance apart from an outer side surface of the shear connector 93, and a sealing rubber pad 82*c* is installed in the sealing groove 82*b*. An upper surface of the sealing rubber pad 82*c* comes in surface contact with a bottom surface of the connection socket.

According to the pier foundation in the PSC pier assembled using precast concrete segments including a steel duct and a steel pipe according to the related art, shear connectors using steel ducts having a short length are installed in portions of the pier foundation and segments to prevent an increase in construction costs, facilitate connection between the segments and the pier foundation, and prevent shear failure of a bonding part. Also, by inserting the steel wire supporting steel pipe between the steel wire and the foundation sheath pipe in order to allow the steel wire to stand on its own, during stacking of the segments, the steel wire stands upright due to the steel wire supporting steel pipe, thus improving constructability and shortening a construction period.

In other words, in the case of the pier foundation in the PSC pier assembled using precast concrete segments including a steel duct and a steel pipe according to the related art, configurations of a rubber pad for preventing leakage of water through filled mortar during connection of a foundation part and a pillar part and a sealing rubber pad installed on an outer peripheral surface of a shear connector during joining of segments are disclosed.

However, there is an inconvenience of having to separately install a sealing/watertight member such as a waterproofing rubber pad and a sealant on a pillar part, a coping part, and a segment joining portion of an existing bridge lower structure, and there is a problem that, when bonding using a binder such as epoxy, epoxy is excessively applied and flows out.

Meanwhile, FIG. 6 is a view illustrating a case in which a steel duct is used as a duct coupler for connecting precast segments according to the related art.

As illustrated in FIG. 6, when steel ducts are embedded and utilized as duct couplers for connecting precast segments according to the related art, in a case in which an error occurs in the positions where the steel ducts are embedded, a problem may occur in a joining portion due to a construction error caused by joining the steel ducts, and accordingly, inserting a steel strand, a steel bar, a reinforcing bar, and the like to connect the precast segments may be greatly interfered with.

RELATED ART DOCUMENTS

Patent Documents (Patent Document 0001) Korean Patent Registration No. 10-738999 (Date of Registration: Jul. 6, 2007), Title of Disclosure: "Precast concrete segment having assembly structure using steel duct and connection and assembly structure thereof"

(Patent Document 0002) Korean Patent Registration No. 10-924746 (Date of Registration: Oct. 27, 2009), Title of Disclosure: "Method of constructing precast coping part to which multi-stage tension is applied"

(Patent Document 0003) Korean Patent Registration No. 10-920204 (Date of Registration: Sep. 28, 2009), Title of Disclosure: "Method of constructing precast foundation part for bridge"

(Patent Document 0004) Korean Patent Registration No. 10-1039656 (Date of Registration: Jun. 1, 2011), Title of Disclosure: "PSC pier assembled using precast concrete segments including steel duct and steel pipe and method of constructing the same"

(Patent Document 0005) Korean Patent Registration No. 10-971003 (Date of Registration: Jul. 12, 2010), Title of Disclosure: "Match casting formwork and method of constructing assembly type precast pier using the same"

(Patent Document 0006) Korean Patent Registration No. 10-971001 (Date of Registration: Jul. 12, 2010), Title of Disclosure: "Assembly type precast pier having fixing plate for shear connection"

(Patent Document 0007) Korean Patent Registration No. 10-950715 (Date of Registration: Mar. 25, 2010), Title of Disclosure: "Method of constructing precast coping part for bridge"

SUMMARY OF THE INVENTION

The present disclosure is directed to providing an assembly type bridge lower structure having a socket type elastic duct coupler and a method of constructing the same in which, in construction of an assembly type bridge lower structure that consists of an assembly type foundation part, an assembly type pillar part, and an assembly type coping part, a socket type elastic duct coupler is utilized to enable shear key joining at connection portions of the assembly type foundation part, the assembly type pillar part, and the assembly type coping part, and construction error displacements of the socket type elastic duct coupler can be accommodated.

The present disclosure is also directed to providing an assembly type bridge lower structure having a socket type elastic duct coupler and a method of constructing the same in which a socket type elastic duct coupler is utilized, thus improving watertightness at connection portions of precast segments and accommodating an insertion angle of an insertion member including a steel strand, a steel bar, a reinforcing bar, a fiber-reinforced polymer (FRP), or the like.

One aspect of the present disclosure provides an assembly type bridge lower structure having a socket type elastic duct coupler, which is an assembly type bridge lower structure constructed by assembling precast segments, the assembly type bridge lower structure including: an assembly type foundation part formed by assembling foundation part precast segments in a horizontal direction and a vertical direction; an assembly type pillar part assembled and constructed on an upper portion of the assembly type foundation part and formed by assembling pillar part precast segments in the vertical direction; an assembly type coping part assembled and constructed on an upper portion of the assembly type pillar part and formed by assembling coping part precast segments in the horizontal direction; a sheath pipe inserted into each of the foundation part precast segments, the pillar part precast segments, and the coping part precast segments; and a socket type elastic duct coupler, which is a duct coupler formed as a socket type and made of an elastic material and is inserted into each of the foundation part precast segments, the pillar part precast segments, and the coping part precast segments to be vertically and horizontally coupled to each of the sheath pipes, wherein a duct-type sheath pipe is embedded in each of the foundation part precast segments, the pillar part precast segments, and the coping part precast segments, and the socket type elastic duct coupler connects each of the sheath pipes.

Here, the socket type elastic duct coupler, which is a duct coupler made of an elastic material such as rubber, may be formed of a lower socket type elastic duct coupler on which an elastic duct coupler convex portion is formed and an upper socket type elastic duct coupler in which an elastic duct coupler concave portion is formed, which may be connected to each other in the form of shear keys.

Here, an insertion member including a steel strand, a steel bar, a reinforcing bar, or a fiber-reinforced polymer (FRP) may be inserted at a predetermined insertion angle into the sheath pipes connected to each other by the socket type elastic duct coupler.

Here, the foundation part precast segments, the pillar part precast segments, and the coping part precast segments may each have a convex portion formed on one side and a concave portion formed in the other side and may be connected in the form of shear keys.

Here, the foundation part precast segments may include a foundation part central precast segment and foundation part adjacent precast segments assembled to both sides of the foundation part central precast segment, and the foundation part central precast segment and the foundation part adjacent precast segments may each have a convex portion formed on one side and a concave portion formed in the other side and may be connected in the form of shear keys.

Here, the pillar part precast segments may include a pillar part lower precast segment and a pillar part upper precast segment assembled onto the pillar part lower precast segment, and the pillar part lower precast segment and the pillar part upper precast segment may each have a convex portion formed on one side and a concave portion formed in the other side and may be connected in the form of shear keys.

Here, the coping part precast segments may include a coping part central precast segment and coping part adjacent precast segments assembled to both sides of the coping part central precast segment, and the coping part central precast segment and the coping part adjacent precast segments may each have a convex portion formed on one side and a concave portion formed in the other side and may be connected in the form of shear keys.

Meanwhile, another aspect of the present disclosure provides a method of constructing an assembly type bridge lower structure having a socket type elastic duct coupler, which is a method of constructing an assembly type bridge lower structure constructed by assembling precast segments, the method including: a) for construction of an assembly type foundation part of the assembly type bridge lower structure, forming foundation part precast segments embedded with the socket type elastic duct coupler; b) assembling and connecting each of the foundation part precast segments embedded with the socket type elastic duct coupler in a horizontal direction and a vertical direction to complete the assembly type foundation part; c) for construction of an assembly type pillar part of the assembly type bridge lower structure, forming pillar part precast segments embedded with the socket type elastic duct coupler; d) on an upper portion of the assembly type foundation part, assembling and connecting each of the pillar part precast segments embedded with the socket type elastic duct coupler in the vertical direction to complete the assembly type pillar part; e) for construction of an assembly type coping part of the assembly type bridge lower structure, forming coping part precast segments embedded with the socket type elastic duct coupler; and f) on an upper portion of the assembly type pillar part, assembling and connecting each of the coping part precast segments embedded with the socket type elastic duct coupler in the horizontal direction to complete the assembly type coping part, wherein a duct-type sheath pipe is embedded in each of the foundation part precast segments, the pillar part precast segments, and the coping part precast segments, and the socket type elastic duct coupler connects each of the sheath pipes.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
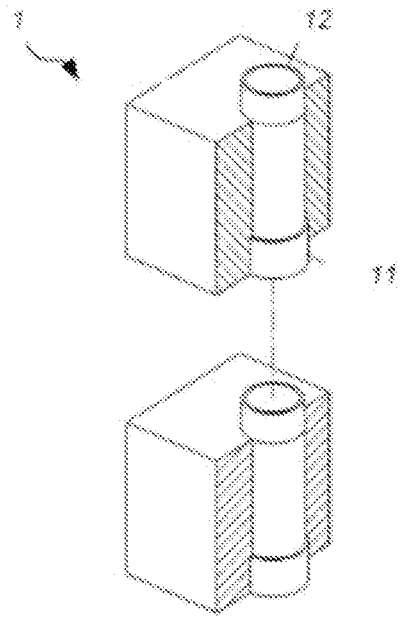
FIG. 1 is a view illustrating the assembly of precast concrete segments having an assembly structure using a steel duct according to the related art.
Figure 1:
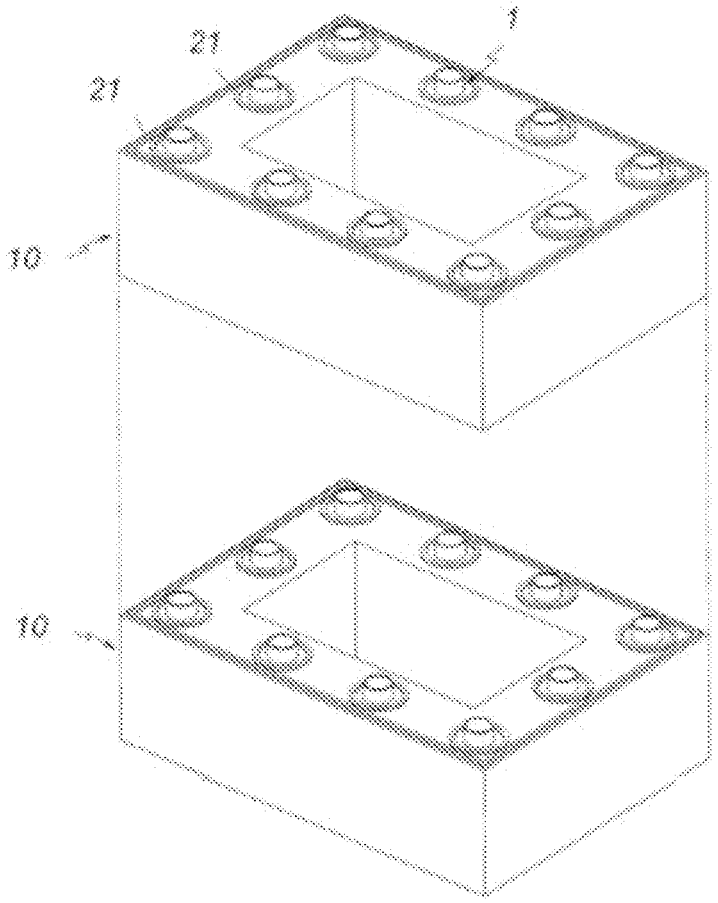
Figure 2:
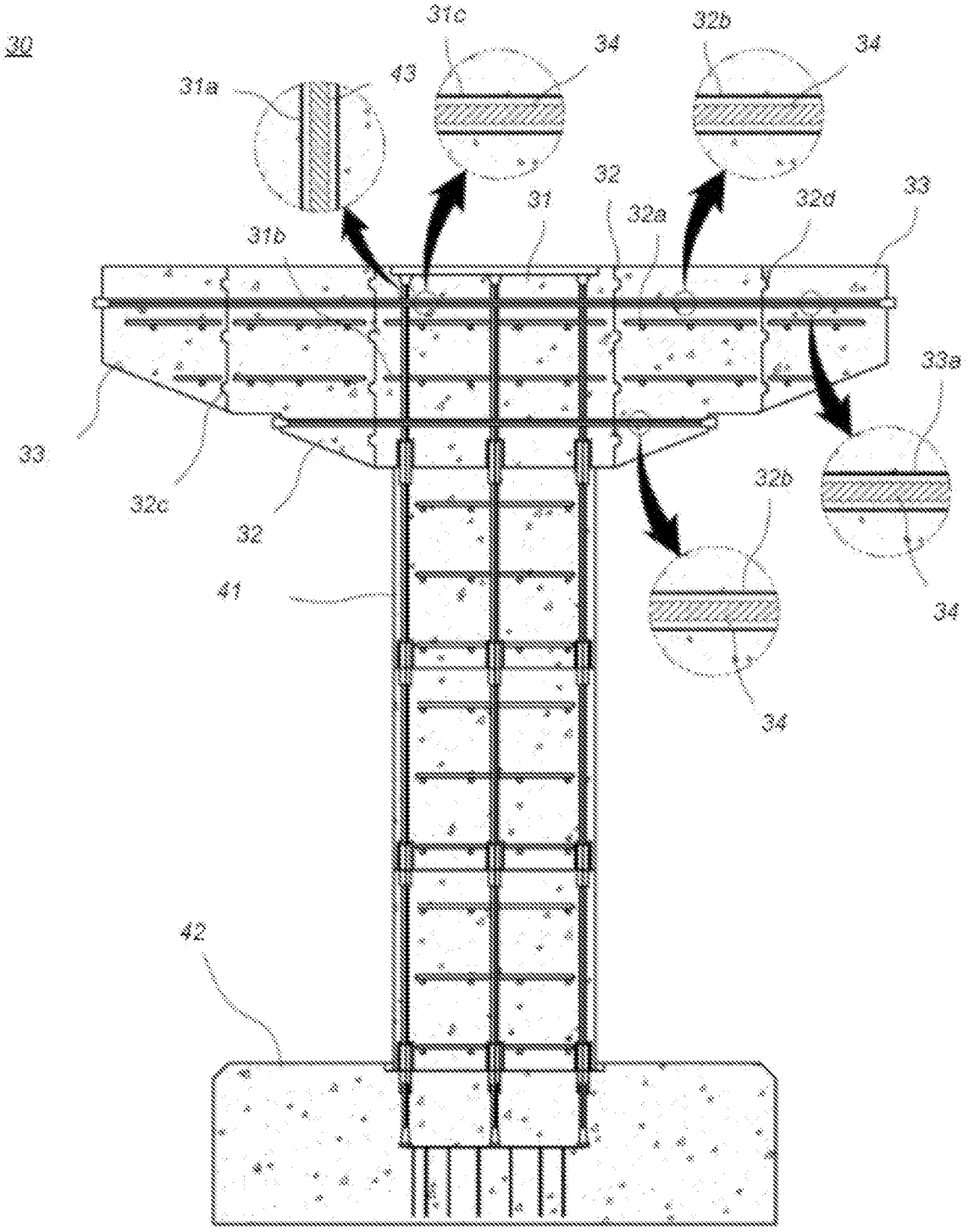
FIG. 2 is a cross-sectional view illustrating a configuration of a precast coping part according to a method of constructing a precast coping part to which multi-stage tension is applied according to the related art.
Figure 3:
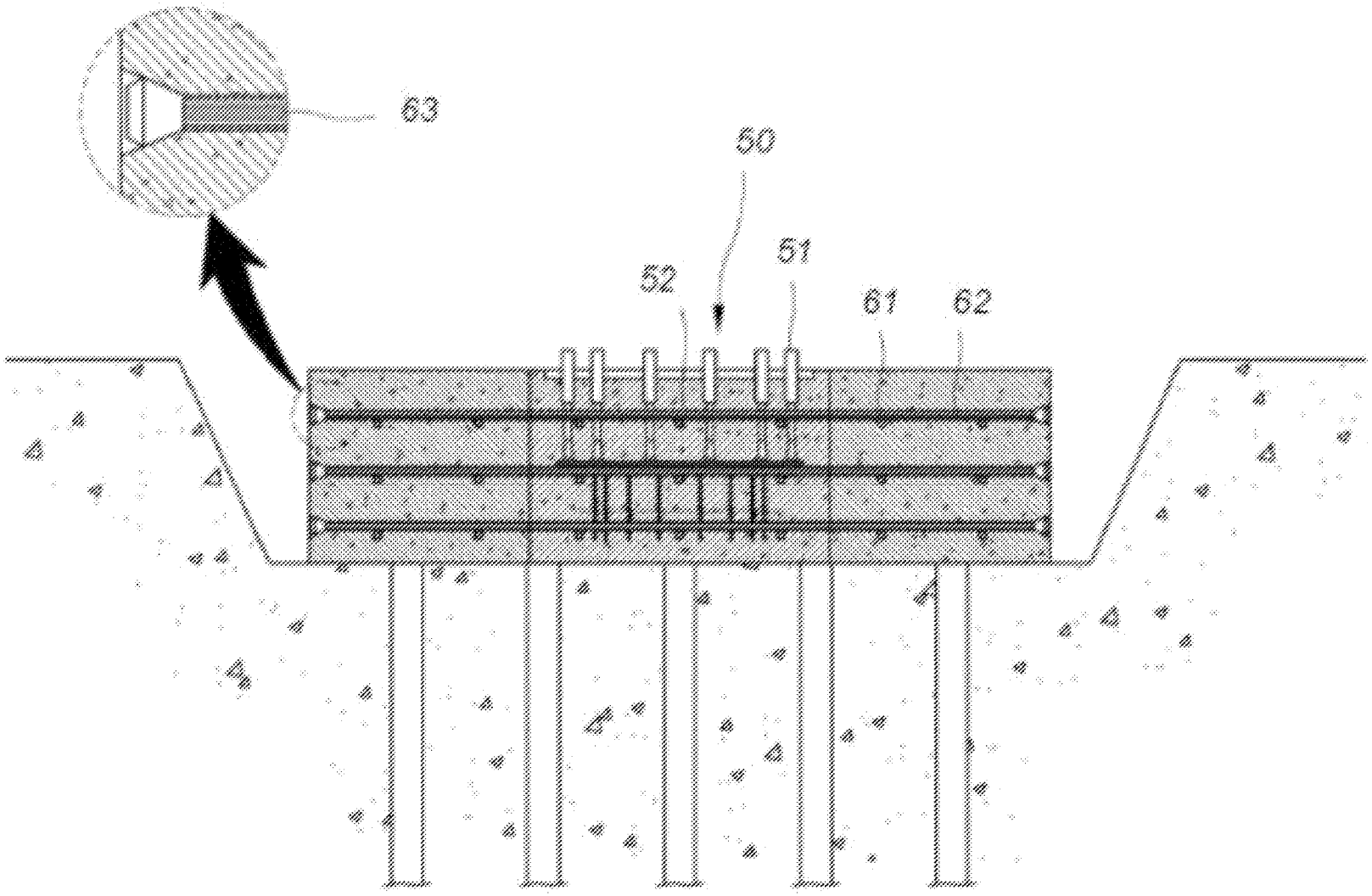
FIG. 3 is a view for describing a method of constructing a precast foundation part for a bridge according to the related art.
Figure 4:
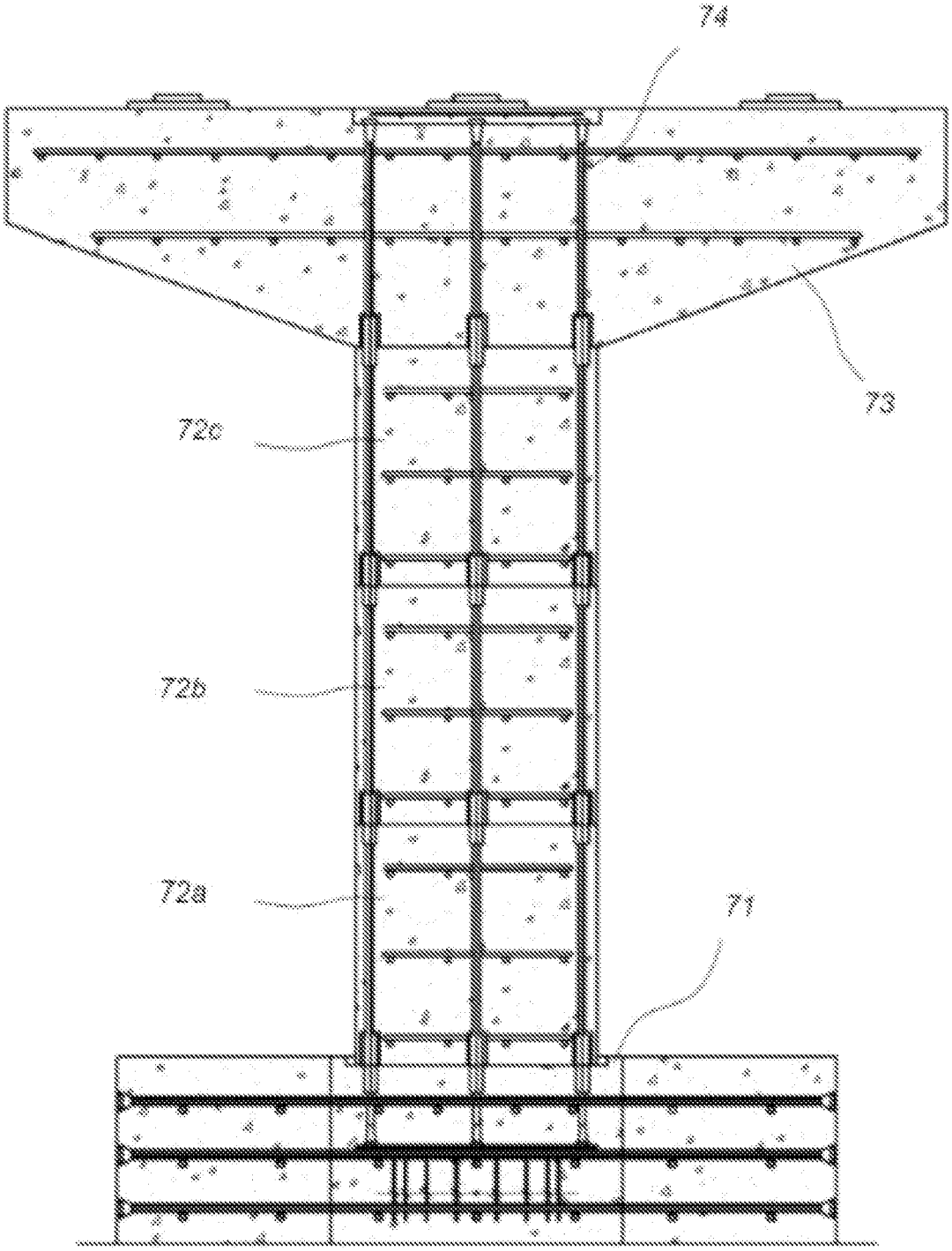
FIG. 4 is a view for describing a match casting technique for construction of an assembly type precast pier according to the related art.
Figure 5A:
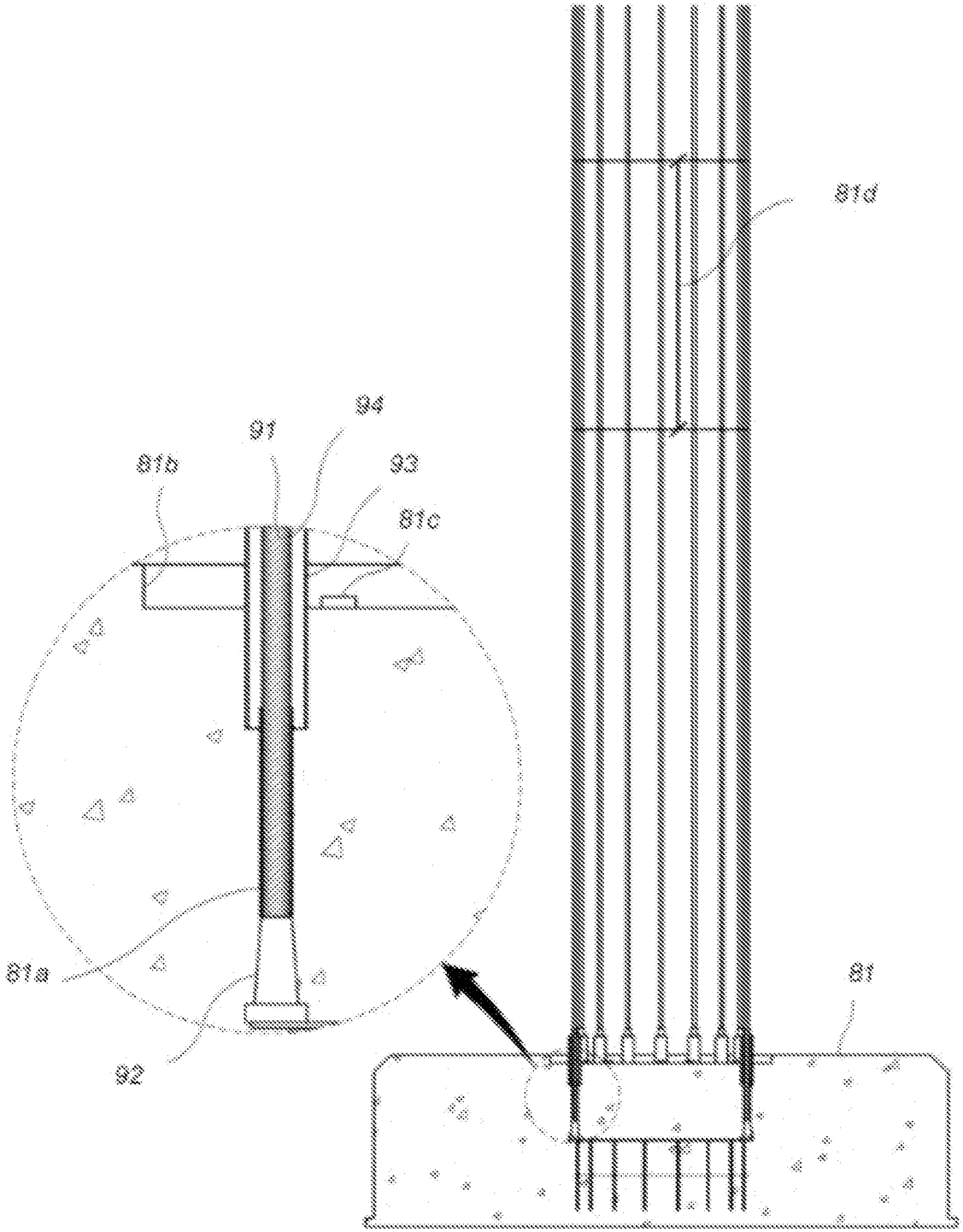
FIG. 5A is a cross-sectional view illustrating a configuration of a pier foundation in a prestressed concrete (PSC) pier assembled using precast concrete segments including a steel duct and a steel pipe according to the related art.
Figure 5B:
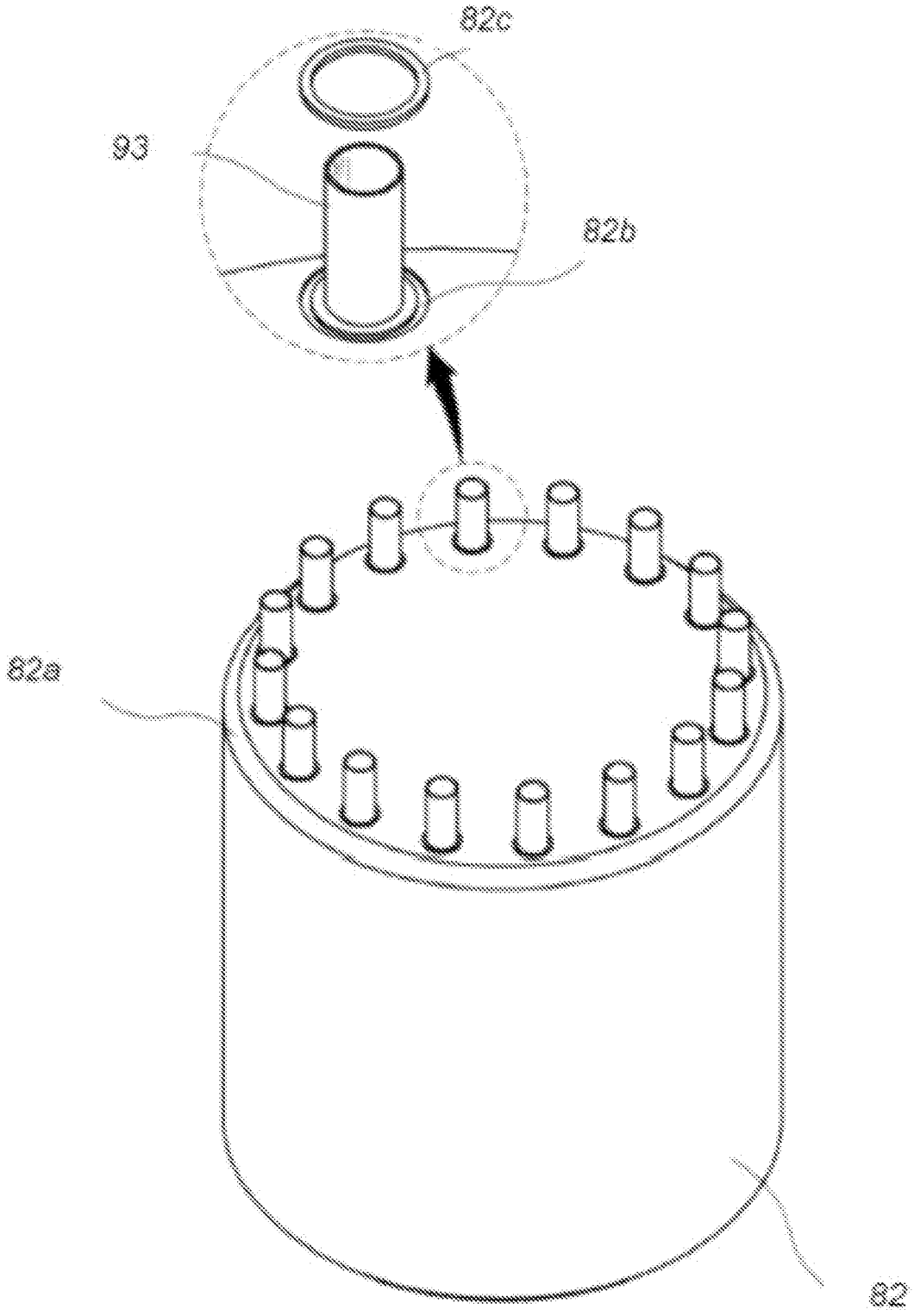
FIG. 5B is a perspective view illustrating a configuration of a segment in the PSC pier assembled using the precast concrete segments including the steel duct and the steel pipe.
Figure 6:
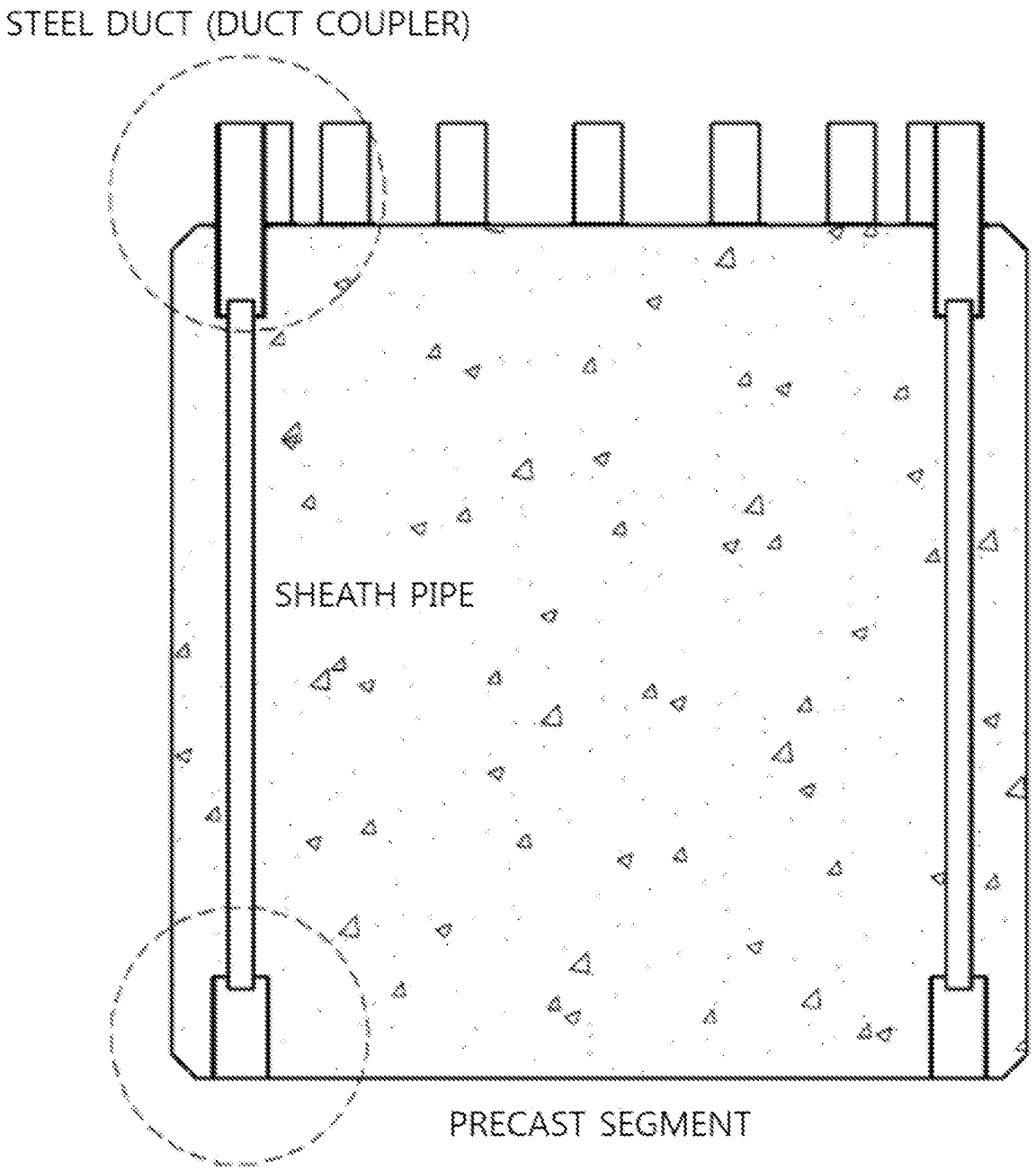
FIG. 6 is a view illustrating a case in which a steel duct is used as a duct coupler for connecting precast segments according to the related art.

Hereinafter, embodiments of the present disclosure will be described in detail with reference to the accompanying drawings to allow those of ordinary skill in the art to which the present disclosure pertains to easily carry out the embodiments of the present disclosure. The present disclosure may be implemented in various different forms and is not limited to the embodiments described herein. In the drawings, parts unrelated to the description are omitted for clarity of the present disclosure, and like elements are denoted by like reference numerals throughout.

Throughout the specification, when a certain part is described as "including" a certain element, this signifies that the certain part may further include another element rather than excluding the other element unless particularly described otherwise.

[Assembly Type Bridge Lower Structure 100 Having Socket Type Elastic Duct Coupler]

Figure 7:
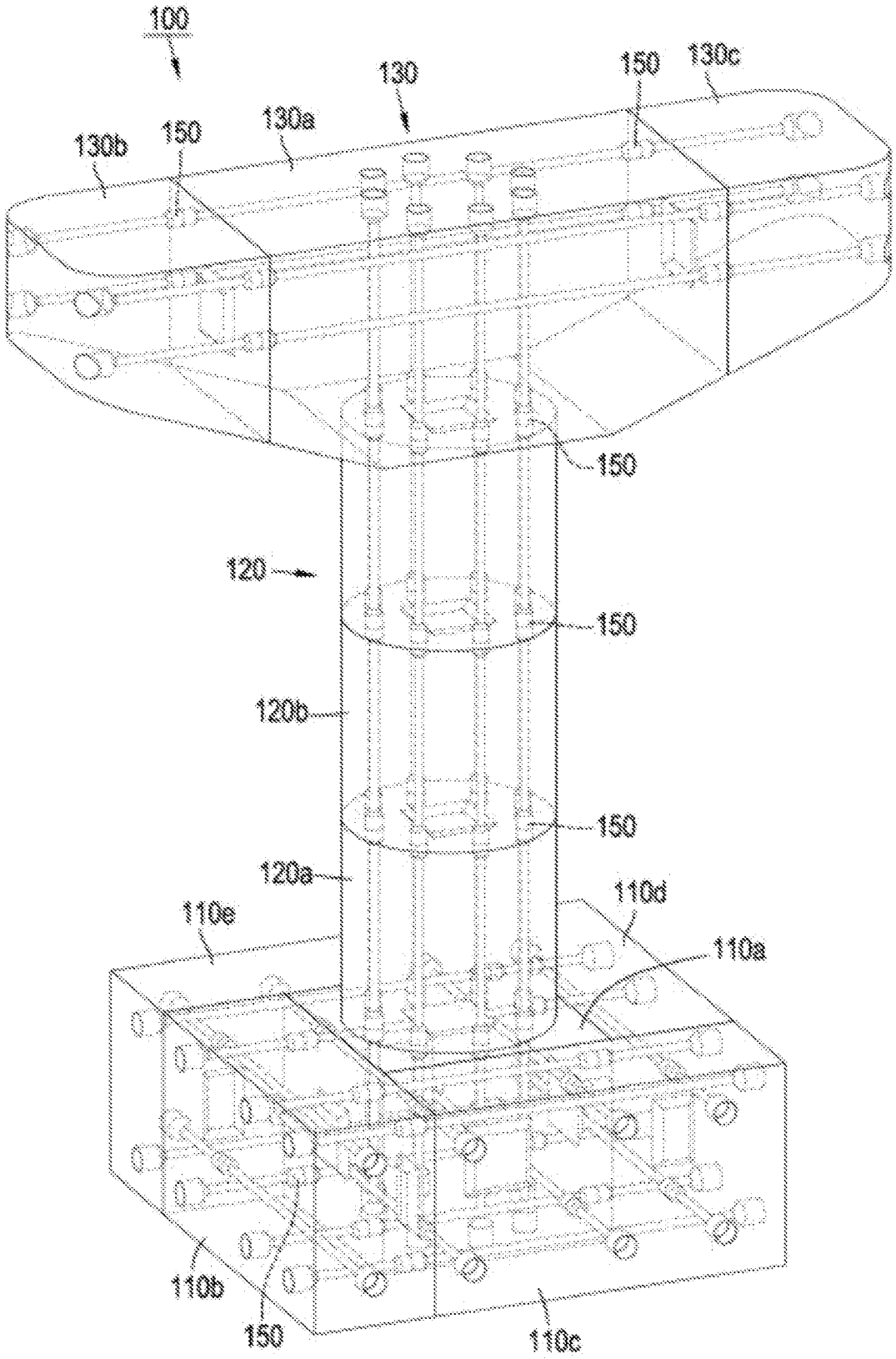
FIG. 7 is a perspective view schematically illustrating an assembly type bridge lower structure having a socket type elastic duct coupler according to an embodiment of the present disclosure.
Figure 8:
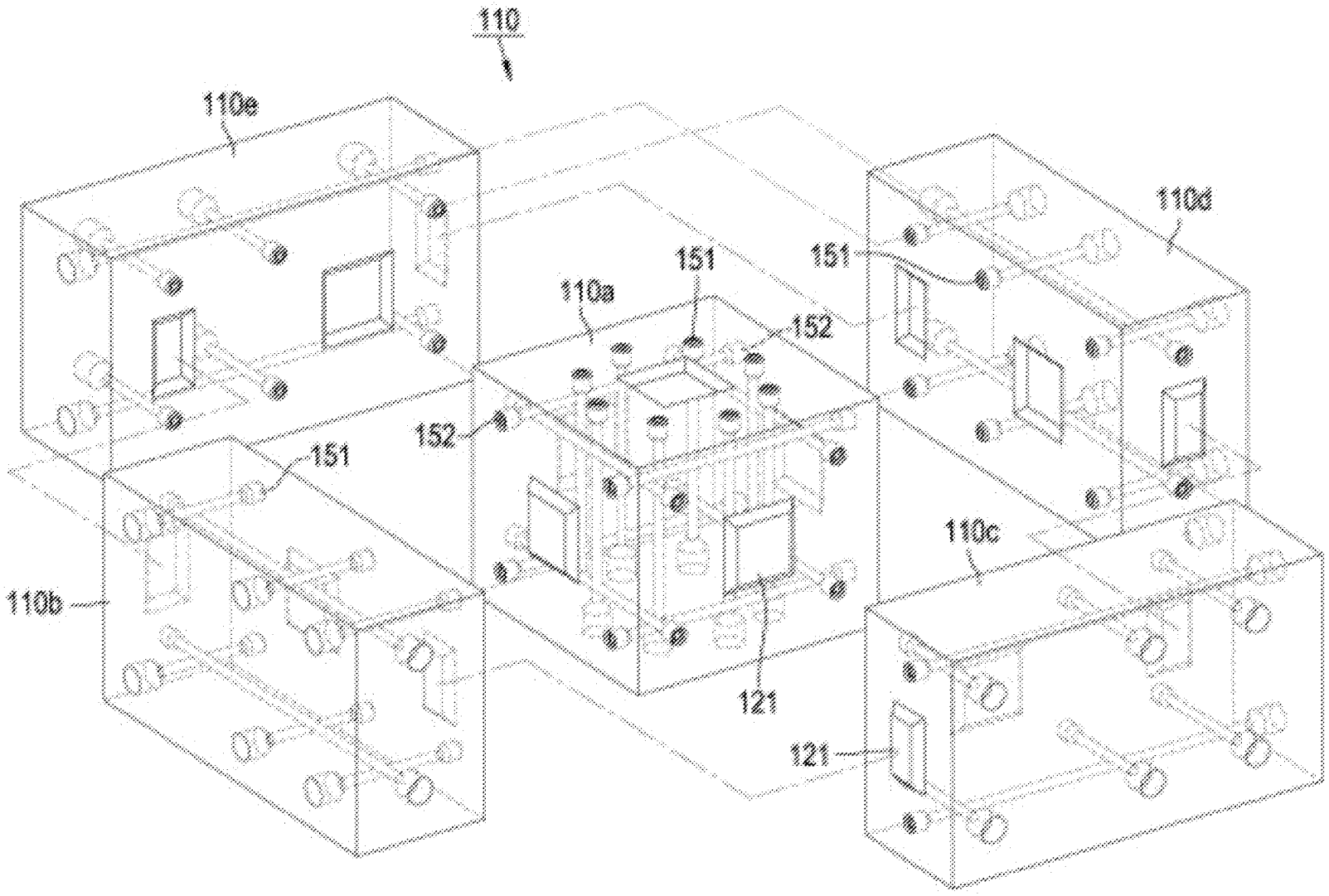
FIG. 8 is a view illustrating an assembly type foundation part assembled in a horizontal direction and a vertical direction in the assembly type bridge lower structure having the socket type elastic duct coupler according to an embodiment of the present disclosure.
Figure 9:
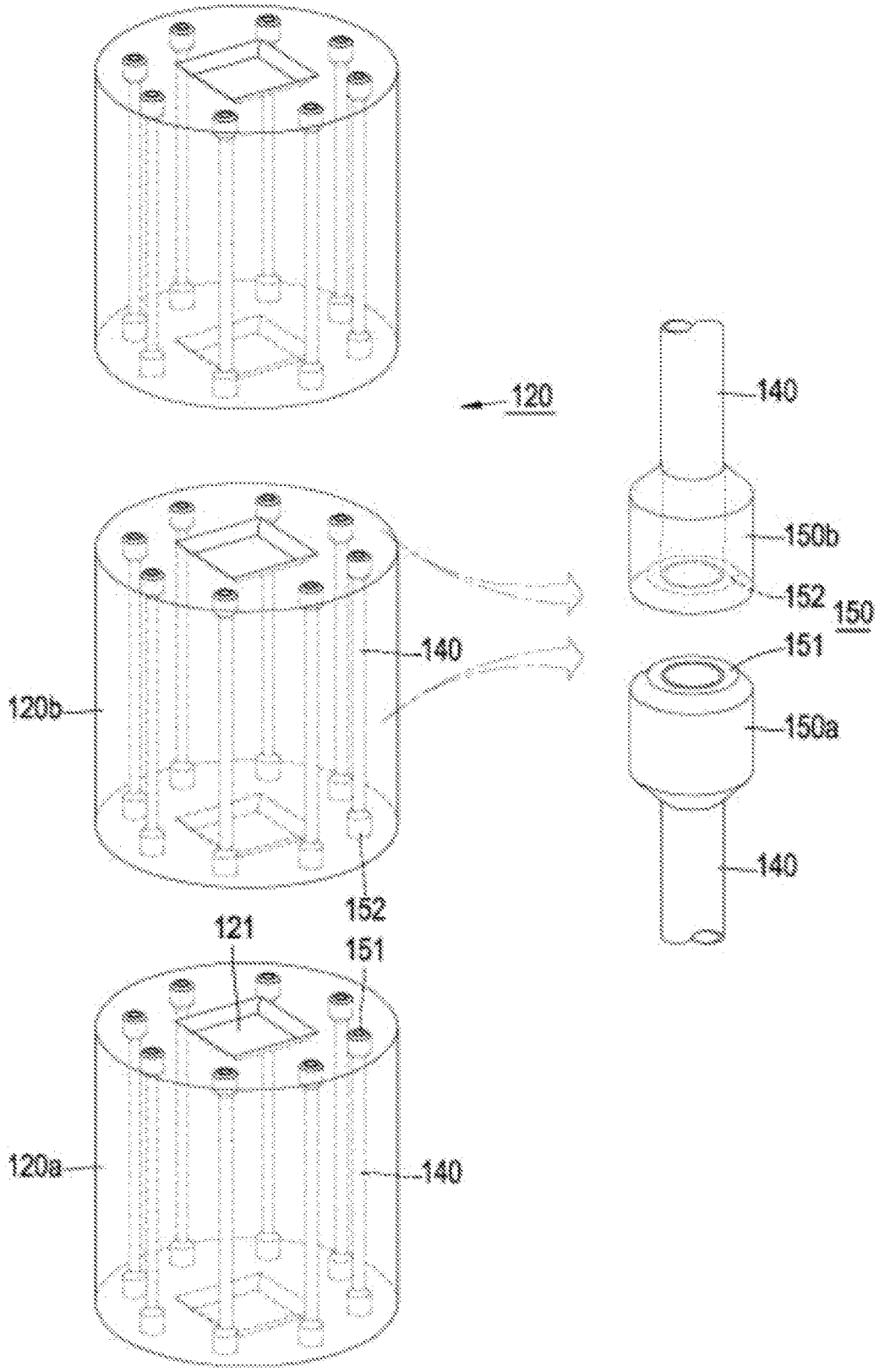
FIG. 9 is a view illustrating an assembly type pillar part assembled in the vertical direction in the assembly type bridge lower structure having the socket type elastic duct coupler according to an embodiment of the present disclosure.
Figure 10:
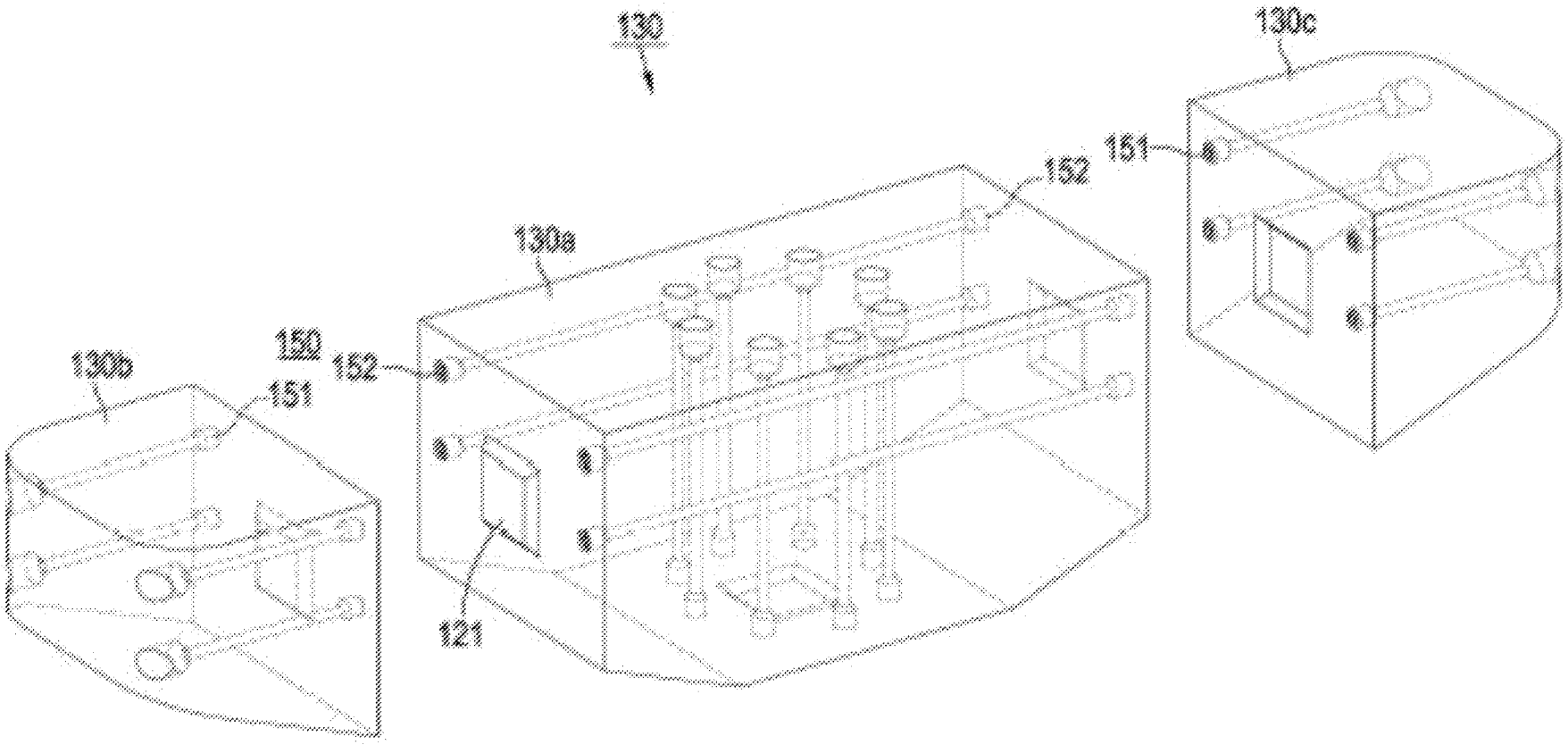
FIG. 10 is a view illustrating an assembly type coping part assembled in the horizontal direction in the assembly type bridge lower structure having the socket type elastic duct coupler according to an embodiment of the present disclosure.

FIG. 7 is a perspective view schematically illustrating an assembly type bridge lower structure having a socket type elastic duct coupler according to an embodiment of the present disclosure, FIG. 8 is a view illustrating an assembly type foundation part assembled in a horizontal direction and a vertical direction in the assembly type bridge lower structure having the socket type elastic duct coupler according to an embodiment of the present disclosure, FIG. 9 is a view illustrating an assembly type pillar part assembled in the vertical direction in the assembly type bridge lower structure having the socket type elastic duct coupler according to an embodiment of the present disclosure, and FIG. 10 is a view illustrating an assembly type coping part assembled in the horizontal direction in the assembly type bridge lower structure having the socket type elastic duct coupler according to an embodiment of the present disclosure.

Referring to FIGS. 7 to 12, an assembly type bridge lower structure 100 having a socket type elastic duct coupler according to an embodiment of the present disclosure is an assembly type bridge lower structure constructed by assembling precast segments and includes an assembly type foundation part 110, an assembly type pillar part 120, an assembly type coping part 130, a sheath pipe 140, and a socket type elastic duct coupler 150.

The assembly type foundation part 110 is formed by assembling foundation part precast segments 110*a*, 110*b*, 110*c*, 110*d*, and 110*e* in a horizontal direction and a vertical direction.

Here, as illustrated in FIG. 8, the foundation part precast segments 110*a*, 110*b*, 110*c*, 110*d*, and 110*e* may include a foundation part central precast segment 110*a* and foundation part adjacent precast segments 110*b*, 110*c*, 110*d*, and 110*e* assembled to four sides of the foundation part central precast segment 110*a*, and the foundation part central precast segment 110*a* and the foundation part adjacent precast segments 110*b*, 110*c*, 110*d*, and 110*e* may each have a convex portion formed on one side and a concave portion formed in the other side and may be connected in the form of shear keys.

The assembly type pillar part 120 is formed by assembling pillar part precast segments 120*a* and 120*b* in the vertical direction and is assembled and constructed on an upper portion of the assembly type foundation part 110.

Here, as illustrated in FIG. 9, the pillar part precast segments 120*a* and 120*b* may include a pillar part lower precast segment 120*a* and a pillar part upper precast segment 120*b* assembled onto the pillar part lower precast segment 120*a*, and the pillar part lower precast segment 120*a* and the pillar part upper precast segment 120*b* may each have a convex portion formed on one side and a concave portion formed in the other side and may be connected in the form of shear keys.

The assembly type coping part 130 is formed by assembling coping part precast segments 130*a*, 130*b*, and 130*c* in the horizontal direction and is assembled and constructed on an upper portion of the assembly type pillar part 120.

Here, as illustrated in FIG. 10, the coping part precast segments 130*a*, 130*b*, and 130*c* may include a coping part central precast segment 130*a* and coping part adjacent precast segments 130*b* and 130*c* assembled to both sides of the coping part central precast segment 130*a*, and the coping part central precast segment 130*a* and the coping part adjacent precast segments 130*b* and 130*c* may each have a convex portion formed on one side and a concave portion formed in the other side and may be connected in the form of shear keys.

Referring to FIGS. 7 and 9, the sheath pipe 140 is inserted into each of the foundation part precast segments 110*a*, 110*b*, 110*c*, 110*d*, and 110*e*, the pillar part precast segments 120*a* and 120*b*, and the coping part precast segments 130*a*, 130*b*, and 130*c*.

The socket type elastic duct coupler 150 is a duct coupler formed as a socket type and made of an elastic material and is inserted into each of the foundation part precast segments 110*a*, 110*b*, 110*c*, 110*d*, and 110*e*, the pillar part precast segments 120*a* and 120*b*, and the coping part precast segments 130*a*, 130*b*, and 130*c* to be vertically and horizontally coupled to each of the sheath pipes 140.

In the case of the assembly type bridge lower structure 100 having the socket type elastic duct coupler according to an embodiment of the present disclosure, the foundation part precast segments 110*a*, 110*b*, 110*c*, 110*d*, and 110*e*, the pillar part precast segments 120*a* and 120*b*, and the coping part precast segments 130*a*, 130*b*, and 130*c* each have a convex portion formed on one side and a concave portion formed in the other side and are connected in the form of shear keys. Also, the duct-type sheath pipe 140 is embedded in each of the foundation part precast segments 110*a*, 110*b*, 110*c*, 110*d*, and 110*e*, the pillar part precast segments 120*a* and 120*b*, and the coping part precast segments 130*a*, 130*b*, and 130*c*, and the socket type elastic duct coupler 150 may connect each of the sheath pipes 140.

Figure 12:
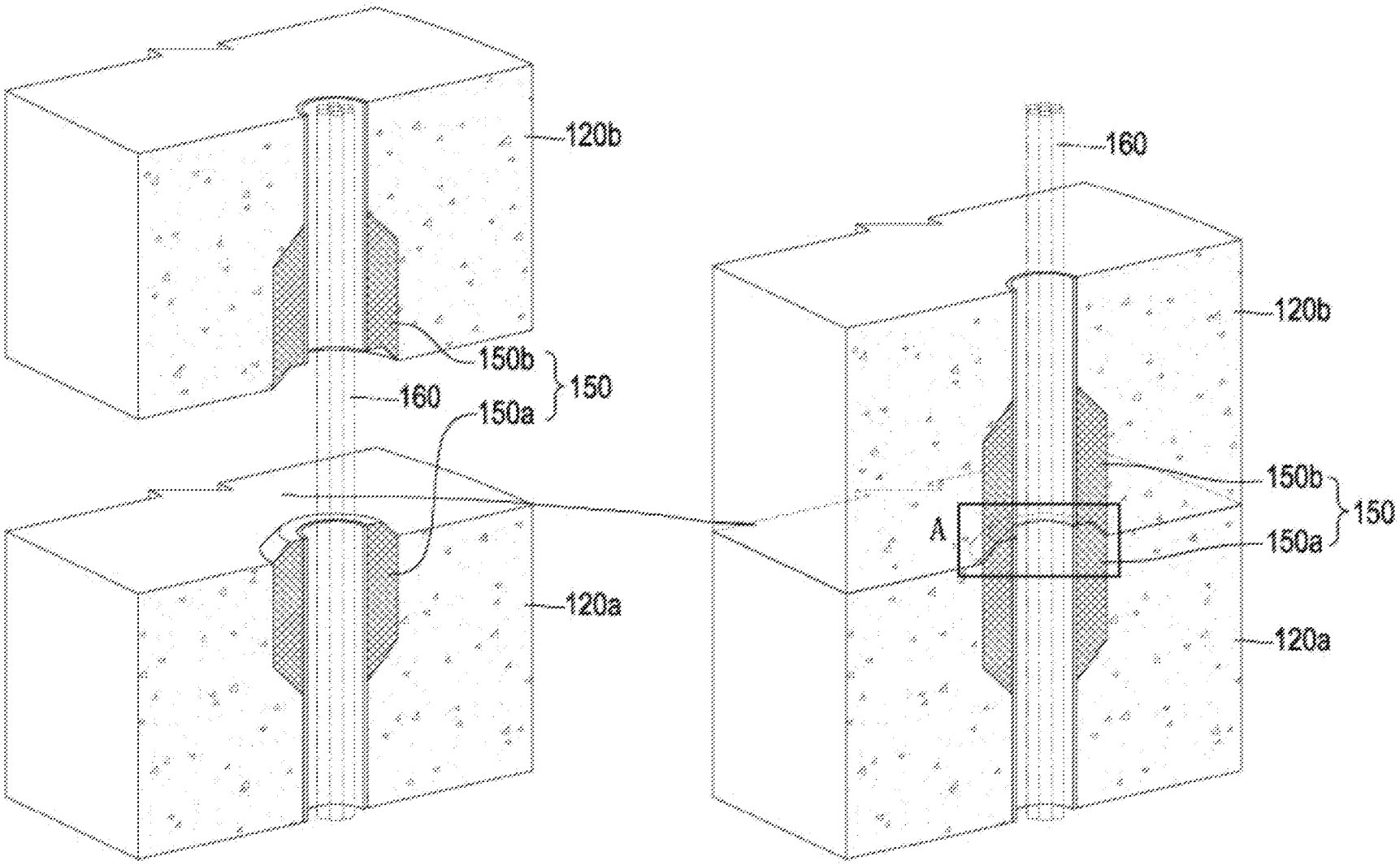
FIG. 12 is a view illustrating in detail a structure of the socket type elastic duct coupler in the assembly type bridge lower structure having the socket type elastic duct coupler according to an embodiment of the present disclosure.

Referring to FIG. 12, an insertion member 160 includes a steel strand, a steel bar, a reinforcing bar, a fiber-reinforced polymer (FRP), or the like, and various other unmentioned new materials may also be used therefor.

According to the assembly type bridge lower structure 100 having the socket type elastic duct coupler according to an embodiment of the present disclosure, an existing steel duct coupler used to insert the insertion member 160 including a steel strand, a steel bar, a reinforcing bar, a FRP, or the like is formed as the socket type elastic duct coupler 150, such as rubber having deformability. In this way, construction errors of the duct coupler may be easily accommodated, watertightness at connection portions may be improved at joining portions of each of the precast segments for forming the bridge lower structure, and an insertion angle may be easily accommodated during insertion of the insertion member including a steel strand, a steel bar, a reinforcing bar, a FRP, or the like.

Figure 11:
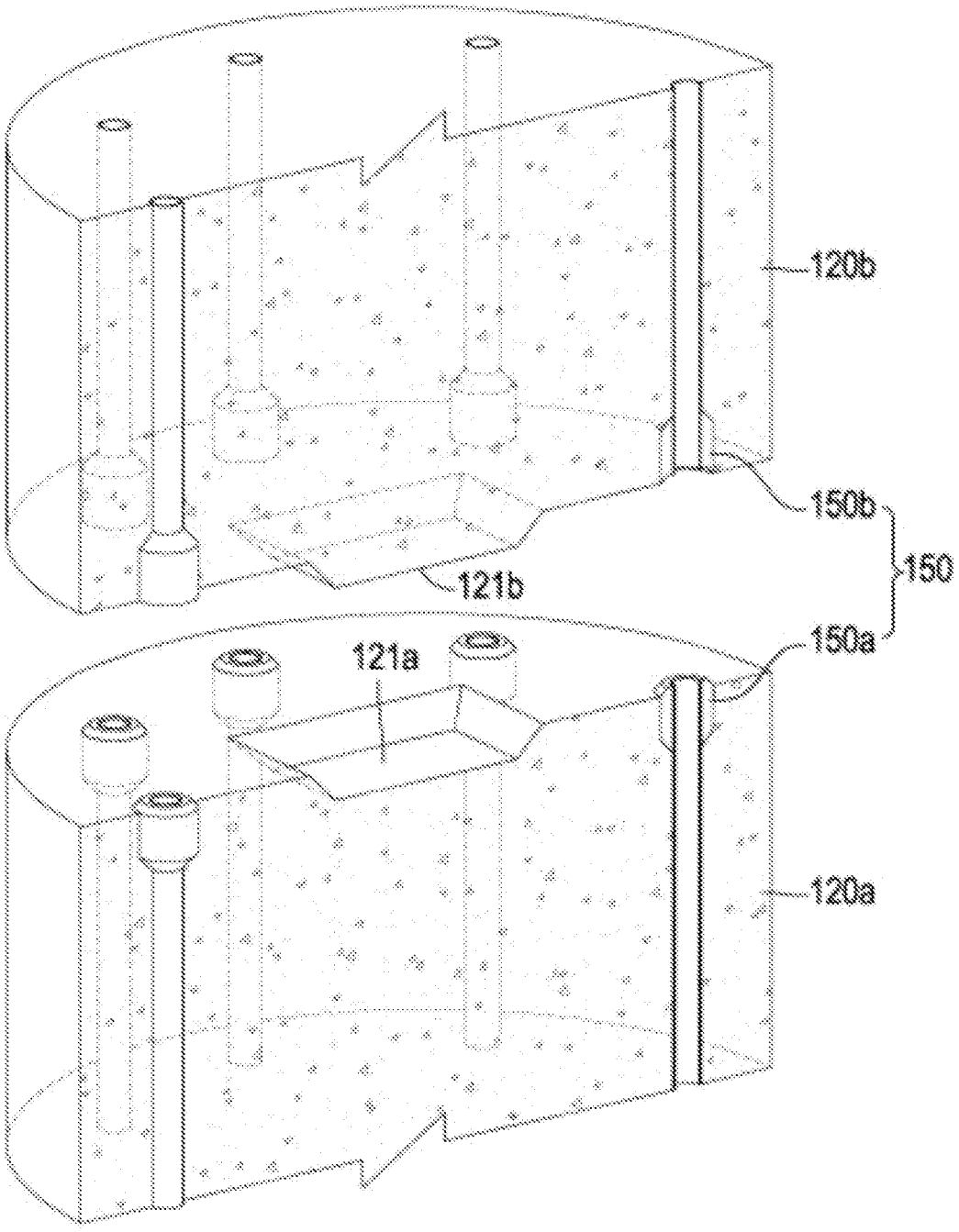
FIG. 11 is a view illustrating a precast segment in which the socket type elastic duct coupler and a shear key are formed in the assembly type bridge lower structure having the socket type elastic duct coupler according to an embodiment of the present disclosure.

Meanwhile, FIG. 11 is a view illustrating a precast segment in which the socket type elastic duct coupler and a shear key are formed in the assembly type bridge lower structure having the socket type elastic duct coupler according to an embodiment of the present disclosure. As illustrated in FIG. 11, specifically, in the precast segments of the assembly type pillar part 120 of the assembly type bridge lower structure 100, in order to maintain stability during construction, a convex portion is formed on the upper precast segment, and a shear key of a concave portion is formed in the lower precast segment so that shear key joining is performed.

Likewise, in the precast segments of the assembly type coping part, in order to maintain stability during construction, a convex portion is formed on the central precast segment, and a shear key of a concave portion is formed in the left and right adjacent precast segments so that shear key joining is performed.

Here, in the case of the assembly type pillar part 120, a lower socket type elastic duct coupler 150*a* on which a convex portion is formed is embedded in the pillar part lower precast segment 120*a*, and an upper socket type elastic duct coupler 150*b* in which a concave portion is formed is embedded in the pillar part upper precast segment 120*b*, and in this way, shear key joining in which the convex portion and the concave portion are coupled to each other in the vertical direction is possible.

Likewise, in the case of the assembly type foundation part 110, a central socket type elastic duct coupler having a convex portion formed in the vertical direction and a concave portion formed in the horizontal direction is embedded in the central portion, an adjacent socket type elastic duct coupler having a concave portion formed in the vertical direction is embedded in the upper precast segment, and an adjacent socket type elastic duct coupler having a convex portion formed in the horizontal direction is embedded in the adjacent portions of the foundation part, and in this way, shear key joining is possible with the precast segments of the assembly type pillar part 120 in the vertical direction, and shear key joining in which the convex portion and the concave portion of the adjacent portions of the assembly type foundation part 110 are coupled to each other in the horizontal direction and the vertical direction is possible.

Likewise, in the case of the assembly type coping part 130, a central socket type elastic duct coupler having a concave portion formed therein is embedded in the coping part central precast segment 130*a*, and an adjacent socket type elastic duct coupler having a convex portion formed thereon is embedded in the left and right coping part adjacent precast segments 130*b* and 130*c*, and in this way, shear key joining in which the convex portion and the concave portion are coupled to each other in the horizontal direction is possible.

Specifically, in the case of the assembly type pillar part 120, the lower socket type elastic duct coupler 150*a* on which a convex portion is formed is embedded in the pillar part lower precast segment 120*a*, and the upper socket type elastic duct coupler 150*b* in which a concave portion is formed is embedded in the pillar part upper precast segment 120*b*, and in this way, shear key joining is possible between the pillar part lower precast segment 120*a* and the pillar part upper precast segment 120*b*, and in the case of the assembly type foundation part 110, a socket type elastic duct coupler having a concave portion formed therein is embedded in the foundation part central precast segment 110*a*, and socket type elastic duct coupler having a convex portion formed thereon is embedded in each of the foundation part adjacent precast segments 110*b*, 110*c*, 110*d*, and 110*e* at both side surfaces, and in this way, shear key joining is also possible between the foundation part central precast segment 110*a* and the foundation part adjacent precast segments 110*b*, 110*c*, 110*d*, and 110*e*. Also, in the case of the assembly type coping part 130, a socket type elastic duct coupler having a concave portion formed therein is embedded in the coping part central precast segment 130*a*, and a socket type elastic duct coupler having a convex portion formed thereon is embedded in the coping part adjacent precast segments 130*b* and 130*c* at both side surfaces, and in this way, shear key joining is also possible between the coping part central precast segment 130*a* and the coping part adjacent precast segments 130*b* and 130*c*. Accordingly, a shear force may be further reinforced in addition to being reinforced by shear key joining configurations of the convex portion and the concave portion formed in advance in each of the precast segments.

Meanwhile, FIG. 12 is a view illustrating in detail the structure of the socket type elastic duct coupler 150 in the assembly type bridge lower structure having the socket type elastic duct coupler 150 according to an embodiment of the present disclosure.

First, the assembly type bridge lower structure 100 having the socket type elastic duct coupler 150 according to an embodiment of the present disclosure is an assembly type bridge lower structure including the assembly type foundation part 110, the assembly type pillar part 120, and the assembly type coping part 130. As the socket type elastic duct coupler 150, a duct coupler is formed of an elastic material such as rubber, and the socket type elastic duct coupler 150 is embedded in each of the precast segments and formed as upper and lower socket type elastic duct couplers.

Here, referring to FIG. 12, the socket type elastic duct coupler 150 may be applied to a vertical connection portion of the precast segments of the assembly type pillar part 120 and may be applied to horizontal connection portions of the precast segments of the assembly type foundation part 110 and the assembly type coping part 130.

Here, the socket type elastic duct coupler 150 for arranging the insertion member 160 including a steel strand, a steel bar, a reinforcing bar, a FRP, or the like may be provided as a plurality of socket type elastic duct couplers 150 embedded in inner peripheral surfaces of the precast segments of each of the assembly type foundation part 110, the assembly type pillar part 120, and the assembly type coping part 130.

Specifically, as illustrated in FIG. 12, the socket type elastic duct coupler 150 is a duct coupler made of an elastic material such as rubber and includes the lower socket type elastic duct coupler 150*a* on which an elastic duct coupler convex portion 151 is formed and the upper socket type elastic duct coupler 150*b* in which an elastic duct coupler concave portion 152 is formed, and the lower socket type elastic duct coupler 150*a* and the upper socket type elastic duct coupler 150*b* may be connected to each other in the form of shear keys at a joining portion indicated by the reference numeral A. Also, the insertion member 160 including a steel strand, a steel bar, a reinforcing bar, a FRP, or the like may be inserted at a predetermined insertion angle into the sheath pipes 140 connected to each other by the socket type elastic duct coupler 150.

According to the socket type elastic duct coupler 150, construction errors of the duct-type sheath pipe 140 and the socket type elastic duct coupler 150 may be easily accommodated, watertightness at connection portions may be improved at horizontal joining portions of the upper and lower precast segments of the assembly type pillar part 120 and the central precast segment and the adjacent precast segments of each of the assembly type coping part 130 and the assembly type foundation part 110, and an insertion angle of the insertion member 160 including a steel strand, a steel bar, a reinforcing bar, a FRP, or the like may be easily accommodated.

Also, in a joining portion between the precast segments, by the socket type elastic duct coupler 150 serving to improve watertightness of the joining portion, it is possible to address an inconvenience of having to install other sealing members on an outer peripheral surface of the sheath pipe 140 or an outer peripheral surface of a shear connector or install other watertight members, such as a rubber pad, on a joining portion between the precast segments during joining of the precast segments.

Consequently, according to an embodiment of the present disclosure, the socket type elastic duct coupler 150 serves as a shear key and is able to reinforce a shear force during joining between the precast segments, construction errors of the socket type elastic duct coupler 150 may be easily accommodated by utilizing characteristics of the elastic material such as rubber, watertightness at connection portions may be improved at joining portions of the lower precast segment, and an insertion angle of the insertion member 160 including a steel strand, a steel bar, a reinforcing bar, a FRP, or the like may be easily accommodated.

Also, according to an embodiment of the present disclosure, in the assembly type pillar part of the assembly type bridge lower structure, shear key joining is performed due to shear keys provided in the form of a convex portion and a concave portion on the pillar part precast segments, and thus stability may be maintained during construction.

Also, according to an embodiment of the present disclosure, in the assembly type coping part of the assembly type bridge lower structure, shear key joining is performed due to shear keys provided in the form of a convex portion and a concave portion on the coping part central precast segment, and thus stability may be maintained during construction.

Also, according to an embodiment of the present disclosure, in the assembly type foundation part of the assembly type bridge lower structure, shear key joining is performed due to shear keys provided in the form of a convex portion and a concave portion on the foundation part central precast segment, and thus stability may be maintained during construction.

Thus, by performing shear key connection between transverse sheath pipes using the socket type elastic duct coupler, a shear force may be reinforced during horizontal connection of the precast segments of the foundation part, the pillar part, and the coping part.

[Method of Constructing Assembly Type Bridge Lower Structure Having Socket Type Elastic Duct Coupler]

Figure 13:
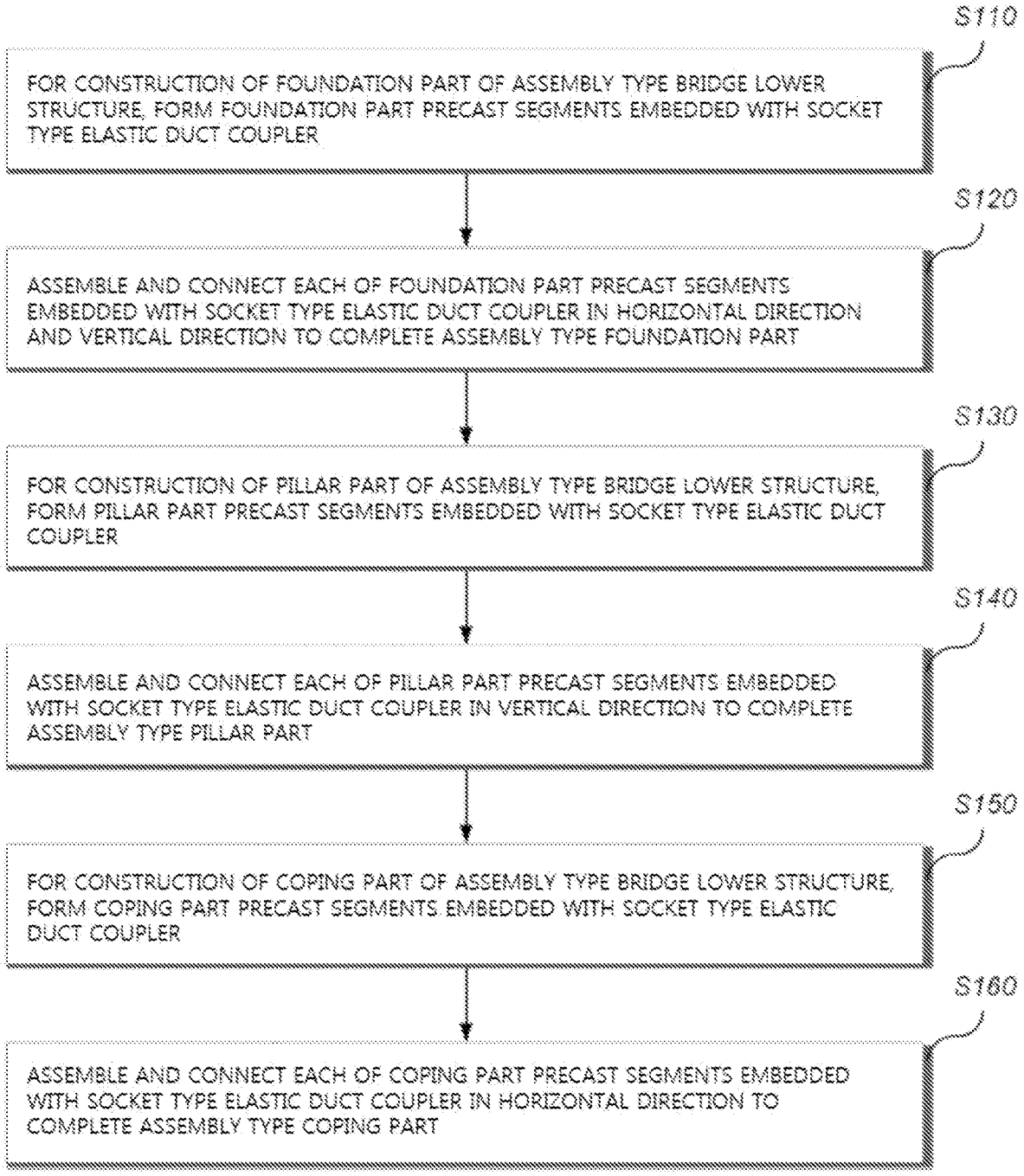
FIG. 13 is an operational flowchart illustrating a method of constructing the assembly type bridge lower structure having the socket type elastic duct coupler according to an embodiment of the present disclosure.

FIG. 13 is an operational flowchart illustrating a method of constructing an assembly type bridge lower structure having a socket type elastic duct coupler according to an embodiment of the present disclosure.

Referring to FIG. 13, in the method of constructing the assembly type bridge lower structure having the socket type elastic duct coupler according to an embodiment of the present disclosure, first, for construction of a foundation part of the assembly type bridge lower structure, foundation part precast segments 110*a*, 110*b*, 110*c*, 110*d*, and 110*e* into which a socket type elastic duct coupler 150 is inserted are formed (S110). Here, the socket type elastic duct coupler 150 is a duct coupler made of an elastic material such as rubber and includes a lower socket type elastic duct coupler 150*a* on which an elastic duct coupler convex portion 151 is formed and an upper socket type elastic duct coupler 150*b* in which an elastic duct coupler concave portion 152 is formed, and the lower socket type elastic duct coupler 150*a* and the upper socket type elastic duct coupler 150*b* may be connected to each other in the form of shear keys.

Next, each of the foundation part precast segments 110*a*, 110*b*, 110*c*, 110*d*, and 110*e* into which the socket type elastic duct coupler 150 is inserted are assembled and connected in a horizontal direction and a vertical direction to complete an assembly type foundation part 110 (S120). Here, the foundation part precast segments 110*a*, 110*b*, 110*c*, 110*d*, and 110*e* may include a foundation part central precast segment 110*a* and foundation part adjacent precast segments 110*b*, 110*c*, 110*d*, and 110*e* assembled to both sides of the foundation part central precast segment 110*a*, and the foundation part central precast segment 110*a* and the foundation part adjacent precast segments 110*b*, 110*c*, 110*d*, and 110*e* may each have a convex portion formed on one side and a concave portion formed in the other side and may be connected in the form of shear keys.

Accordingly, in the case of the assembly type foundation part 110 of the complete assembly type bridge lower structure according to an embodiment of the present disclosure, a central socket type elastic duct coupler having a convex portion formed in the vertical direction and a concave portion formed in the horizontal direction is embedded in the central portion, an adjacent socket type elastic duct coupler having a concave portion formed in the vertical direction is embedded in the upper precast segment of the assembly type pillar part, and an adjacent socket type elastic duct coupler having a convex portion formed in the horizontal direction is embedded in the adjacent portions of the assembly type foundation part 110, and in this way, shear key joining is possible with the precast segments of the assembly type pillar part in the vertical direction, and shear key joining of the adjacent portions of the assembly type foundation part 110 is possible in the horizontal direction.

Next, for construction of the assembly type pillar part of the assembly type bridge lower structure, pillar part precast segments 120*a* and 120*b* into which the socket type elastic duct coupler is inserted are formed (S130).

Next, each of the pillar part precast segments 120*a* and 120*b* into which the socket type elastic duct coupler is inserted is assembled and connected in the vertical direction to complete the assembly type pillar part 120 (S140). Here, the pillar part precast segments 120*a* and 120*b* may include a pillar part lower precast segment 120*a* and a pillar part upper precast segment 120*b* assembled onto the pillar part lower precast segment 120*a*, and the pillar part lower precast segment 120*a* and the pillar part upper precast segment 120*b* may each have a convex portion formed on one side and a concave portion formed in the other side and may be connected in the form of shear keys. Accordingly, in the case of the assembly type pillar part 120 of the complete assembly type bridge lower structure 100 according to an embodiment of the present disclosure, the socket type elastic duct coupler 150, such as rubber, is provided as a plurality of socket type elastic duct couplers 150 embedded in inner peripheral surfaces of the precast segments, an upper socket type elastic duct coupler in which a concave portion is formed is embedded in the upper precast segment, and a lower socket type elastic duct coupler on which a convex portion is formed is embedded in the lower precast segment, and in this way, shear key joining is also possible between the upper precast segment and the lower precast segment.

Next, for construction of an assembly type coping part of the assembly type bridge lower structure, coping part precast segments 130*a*, 130*b*, and 130*c* into which the socket type elastic duct coupler is inserted are formed (S150).

Next, each of the coping part precast segments 130*a*, 130*b*, and 130*c* into which the socket type elastic duct coupler is inserted are assembled and connected in the horizontal direction to complete the assembly type coping part 130 (S160). Here, the coping part precast segments 130*a*, 130*b*, and 130*c* may include a coping part central precast segment 130*a* and coping part adjacent precast segments 130*b* and 130*c* assembled to both sides of the coping part central precast segment 130*a*, and the coping part central precast segment 130*a* and the coping part adjacent precast segments 130*b* and 130*c* may each have a convex portion formed on one side and a concave portion formed in the other side and may be connected in the form of shear keys. Accordingly, in the case of the assembly type coping part 130 of the complete assembly type bridge lower structure according to an embodiment of the present disclosure, a central socket type elastic duct coupler having a concave portion formed therein is embedded in the central precast segment, and an adjacent socket type elastic duct coupler having a convex portion formed thereon is embedded in the adjacent precast segments, and in this way, shear key joining in the horizontal direction is possible between the central precast segment and the adjacent precast segments.

Also, the duct-type sheath pipe 140 is embedded in each of the foundation part precast segments 110*a*, 110*b*, 110*c*, 110*d*, and 110*e*, the pillar part precast segments 120*a* and 120*b*, and the coping part precast segments 130*a*, 130*b*, and 130*c*, and the socket type elastic duct coupler 150 connects each of the sheath pipes 140. Also, the insertion member 160 including a steel strand, a steel bar, a reinforcing bar, a FRP, or the like may be inserted at a predetermined insertion angle into the sheath pipes 140 connected to each other by the socket type elastic duct coupler 150.

Accordingly, the assembly type bridge lower structure 100 formed of the assembly type foundation part 110, the assembly type pillar part 120, and the assembly type coping part 130 according to an embodiment of the present disclosure is completed. Subsequently, by constructing a girder, a slab, and the like, which are assembly type bridge upper structures, on an upper portion of the assembly type bridge lower structure 100, an assembly type bridge may be completed.

Consequently, according to an embodiment of the present disclosure, in construction of the assembly type bridge lower structure that consists of the assembly type foundation part, the assembly type pillar part, and the assembly type coping part, by utilizing the socket type elastic duct coupler, shear key joining is possible at connection portions of the assembly type foundation part, the assembly type pillar part, and the assembly type coping part, and construction error displacements of the socket type elastic duct coupler may be easily accommodated. Also, by utilizing the socket type elastic duct coupler, watertightness at connection portions of the precast segments may be improved, and an insertion angle of the insertion member including a steel strand, a steel bar, a reinforcing bar, a FRP, or the like may be easily accommodated. Also, an overflow phenomenon that occurs when epoxy is excessively applied during bonding between the precast segments may be prevented.

According to the present disclosure, in construction of an assembly type bridge lower structure that consists of an assembly type foundation part, an assembly type pillar part, and an assembly type coping part, by utilizing a socket type elastic duct coupler, shear key joining is possible at connection portions of the assembly type foundation part, the assembly type pillar part, and the assembly type coping part, and construction error displacements of the socket type elastic duct coupler can be easily accommodated.

According to the present disclosure, by utilizing a socket type elastic duct coupler, watertightness at connection portions of precast segments can be improved, and an insertion angle of an insertion member including a steel strand, a steel bar, a reinforcing bar, a FRP, or the like can be easily accommodated.

According to the present disclosure, it is possible to prevent an overflow phenomenon that occurs when epoxy is excessively applied during bonding between precast segments.

According to the present disclosure, in the assembly type pillar part in the assembly type bridge lower structure, since pillar part precast segments have shear keys provided in the form of a convex portion and a concave portion and shear key joining is performed, stability can be maintained during construction.

According to the present disclosure, in the assembly type coping part in the assembly type bridge lower structure, since a coping part central precast segment has shear keys provided in the form of a convex portion and a concave portion and shear key joining is performed, stability can be maintained during construction.

According to the present disclosure, in the assembly type foundation part in the assembly type bridge lower structure, by shear key connection of transverse sheath pipes using a socket type elastic duct coupler, a shear force can be reinforced during horizontal connection of foundation part precast segments.

The above-given description of the present disclosure is merely illustrative, and those of ordinary skill in the art to which the present disclosure pertains should understand that the present disclosure may be easily modified in other specific forms without changing the technical spirit or essential features of the present disclosure. Therefore, the embodiments described above should be understood as being illustrative, instead of limiting, in all aspects. For example, each element described as a single type may also be embodied in a distributed manner, and likewise, elements described as being distributed may also be embodied in a combined form.

The scope of the present disclosure is defined by the appended claims rather than by the detailed description above, and all changes or modifications derived from the meaning and scope of the claims and their equivalents should be interpreted as falling within the scope of the present disclosure.

What is claimed is:

1. An assembly type bridge lower structure having a socket type elastic duct coupler, which is an assembly type bridge lower structure constructed by assembling precast segments, the assembly type bridge lower structure comprising:

an assembly type foundation part formed by assembling foundation part precast segments in a horizontal direction and a vertical direction;

an assembly type pillar part assembled and constructed on an upper portion of the assembly type foundation part and formed by assembling pillar part precast segments in the vertical direction;

an assembly type coping part assembled and constructed on an upper portion of the assembly type pillar part and formed by assembling coping part precast segments in the horizontal direction;

a sheath pipe inserted into each of the foundation part precast segments, the pillar part precast segments, and the coping part precast segments; and a socket type elastic duct coupler that is a duct coupler formed as a socket type and made of an elastic material and is inserted into each of the foundation part precast segments, the pillar part precast segments, and the coping part precast segments to be vertically and horizontally coupled to each of the sheath pipes, wherein each of the sheath pipes is a duct-type sheath pipe and is embedded in each of the foundation part precast segments, the pillar part precast segments, and the coping part precast segments, and the socket type elastic duct coupler connects each of the sheath pipes.

2. The assembly type bridge lower structure of claim 1, wherein the socket type elastic duct coupler, which is a duct coupler made of an elastic material such as rubber, is formed of a lower socket type elastic duct coupler on which an elastic duct coupler convex portion is formed and an upper socket type elastic duct coupler in which an elastic duct coupler concave portion is formed, which are connected to each other in a form of shear keys.

3. The assembly type bridge lower structure of claim 2, wherein an insertion member including a steel strand, a steel bar, a reinforcing bar, or a fiber-reinforced polymer is inserted at a predetermined insertion angle into the sheath pipes connected to each other by the socket type elastic duct coupler.

4. The assembly type bridge lower structure of claim 1, wherein the foundation part precast segments, the pillar part precast segments, and the coping part precast segments each have a convex portion formed on one side and a concave portion formed in the other side and are connected in a form of shear keys.

5. The assembly type bridge lower structure of claim 1, wherein the foundation part precast segments include a foundation part central precast segment and foundation part adjacent precast segments assembled to both sides of the foundation part central precast segment, and the foundation part central precast segment and the foundation part adjacent precast segments each have a convex portion formed on one side and a concave portion formed in the other side and are connected in a form of shear keys.

6. The assembly type bridge lower structure of claim 1, wherein the pillar part precast segments include a pillar part lower precast segment and a pillar part upper precast segment assembled onto the pillar part lower precast segment, and the pillar part lower precast segment and the pillar part upper precast segment each have a convex portion formed on one side and a concave portion formed in the other side and are connected in a form of shear keys.

7. The assembly type bridge lower structure of claim 1, wherein the coping part precast segments include a coping part central precast segment and coping part adjacent precast segments assembled to both sides of the coping part central precast segment, and the coping part central precast segment and the coping part adjacent precast segments each have a convex portion formed on one side and a concave portion formed in the other side and are connected in a form of shear keys.

8. A method of constructing an assembly type bridge lower structure having a socket type elastic duct coupler, which is a method of constructing an assembly type bridge lower structure constructed by assembling precast segments, the method comprising:

a) for construction of an assembly type foundation part of the assembly type bridge lower structure, forming foundation part precast segments embedded with a socket type elastic duct coupler;

b) assembling and connecting each of the foundation part precast segments embedded with the socket type elastic duct coupler in a horizontal direction and a vertical direction to complete the assembly type foundation part;

c) for construction of an assembly type pillar part of the assembly type bridge lower structure, forming pillar part precast segments embedded with the socket type elastic duct coupler;

d) on an upper portion of the assembly type foundation part, assembling and connecting each of the pillar part precast segments embedded with the socket type elastic duct coupler in the vertical direction to complete the assembly type pillar part;

e) for construction of an assembly type coping part of the assembly type bridge lower structure, forming coping part precast segments embedded with the socket type elastic duct coupler; and f) on an upper portion of the assembly type pillar part, assembling and connecting each of the coping part precast segments embedded with the socket type elastic duct coupler in the horizontal direction to complete the assembly type coping part, wherein a duct-type sheath pipe is embedded in each of the foundation part precast segments, the pillar part precast segments, and the coping part precast segments, and the socket type elastic duct coupler connects each of the sheath pipes.

9. The method of claim 8, wherein the socket type elastic duct coupler, which is a duct coupler made of an elastic material such as rubber, is formed of a lower socket type elastic duct coupler on which an elastic duct coupler convex portion is formed and an upper socket type elastic duct coupler in which an elastic duct coupler concave portion is formed, which are connected to each other in a form of shear keys.

10. The method of claim 9, wherein an insertion member including a steel strand, a steel bar, a reinforcing bar, or a fiber-reinforced polymer is inserted at a predetermined insertion angle into the sheath pipes connected to each other by the socket type elastic duct coupler.

11. The method of claim 10, wherein the foundation part precast segments, the pillar part precast segments, and the coping part precast segments each have a convex portion formed on one side and a concave portion formed in the other side and are connected in a form of shear keys.

12. The method of claim 10, wherein the foundation part precast segments include a foundation part central precast segment and foundation part adjacent precast segments assembled to both sides of the foundation part central precast segment, and the foundation part central precast segment and the foundation part adjacent precast segments each have a convex portion formed on one side and a concave portion formed in the other side and are connected in a form of shear keys.

13. The method of claim 10, wherein the pillar part precast segments include a pillar part lower precast segment and a pillar part upper precast segment assembled onto the pillar part lower precast segment, and the pillar part lower precast segment and the pillar part upper precast segment each have a convex portion formed on one side and a concave portion formed in the other side and are connected in a form of shear keys.

14. The method of claim 10, wherein the coping part precast segments include a coping part central precast segment and coping part adjacent precast segments assembled to both sides of the coping part central precast segment, and the coping part central precast segment and the coping part adjacent precast segments each have a convex portion formed on one side and a concave portion formed in the other side and are connected in a form of shear keys.

* * * * *